US007608793B2

(12) United States Patent
Agronin et al.

(10) Patent No.: US 7,608,793 B2
(45) **Date of Patent: *Oct. 27, 2009**

(54) REMOTE CONTROLLED WALL SWITCH ACTUATOR

(75) Inventors: Michael L. Agronin, Owing Mills, MD (US); James D. Marshall, Mallorytown, CA (US); Rafe D. Bennett, Ellicott City, MD (US); Joe Rogers, Jarrettsville, MD (US); Robert H. Gifford, New Freedom, PA (US); Carolyn M. Martin, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/115,797

(22) Filed: May 6, 2008

(65) Prior Publication Data

US 2008/0202909 A1 Aug. 28, 2008

Related U.S. Application Data

(63) Continuation of application No. 11/044,552, filed on Jan. 25, 2005, now Pat. No. 7,372,355.

(60) Provisional application No. 60/539,551, filed on Jan. 27, 2004.

(51) Int. Cl.
*H01H 17/00* (2006.01)

(52) U.S. Cl. ..... 200/331; 337/123; 337/139

(58) Field of Classification Search ..... 200/330, 200/331, 332.1; 337/123, 126, 139, 140
See application file for complete search history.

(56) References Cited

U.S. PATENT DOCUMENTS 2,078,147 A 4/1937 Linde
2,211,819 A 8/1940 Innis
2,515,932 A 7/1950 Stang et al.
2,524,215 A 10/1950 Wegehoft
2,578,632 A 12/1951 Miller
3,171,920 A 3/1965 Klein et al.
3,178,947 A 4/1965 Keefe
3,179,396 A 4/1965 Bracken (Continued)

FOREIGN PATENT DOCUMENTS

JP 59-049616 3/1984

OTHER PUBLICATIONS

Instruction Manual for Room Gear™, Lights Off™ Remote Control Light Switch, www.wildplanet.com, May 9, 2002.

*Primary Examiner*—Kyung Lee
(74) *Attorney, Agent, or Firm*—Harness, Dickey & Pierce, P.L.C.

(57) ABSTRACT

A device to actuate a switch. The switch has a switch toggle movable between a first position and a second position. The device includes a switch yoke movable between the first position and the second position adapted to engage the switch toggle and move therewith. The device also includes a first linkage connected to the switch yoke. The first linkage applies a force in response to an input signal to move the switch yoke from the first position to the second position. The first linkage includes a shape memory alloy. The device is configured to permit manual actuation of the switch toggle.

20 Claims, 19 Drawing Sheets

U.S. PATENT DOCUMENTS

| | | | |
|---|---|---|---|
| 3,518,356 | A | 6/1970 | Friedman |
| 3,590,648 | A | 7/1971 | Gorman |
| 3,634,803 | A | 1/1972 | Willson et al. |
| 3,725,835 | A | 4/1973 | Hopkins et al. |
| 3,818,156 | A | 6/1974 | Augustyniak |
| 3,968,380 | A | 7/1976 | Jost et al. |
| 3,985,982 | A | 10/1976 | Schneidinger |
| 3,988,553 | A | 10/1976 | Astle |
| 4,007,404 | A | 2/1977 | Jost et al. |
| 4,015,139 | A | 3/1977 | Cleary et al. |
| 4,506,120 | A | 3/1985 | Fleischman |
| 4,508,943 | A | 4/1985 | Pfeiffer et al. |
| 4,544,988 | A | 10/1985 | Hochstein |
| 4,597,505 | A | 7/1986 | Mozley et al. |
| 4,645,942 | A | 2/1987 | Nilssen |
| 4,700,541 | A | 10/1987 | Gabriel et al. |
| 4,825,686 | A | 5/1989 | Marsh |
| 4,835,413 | A | 5/1989 | Nilssen |
| 4,887,430 | A | 12/1989 | Kroll et al. |
| 4,912,376 | A | 3/1990 | Strick |
| 4,949,061 | A | 8/1990 | Kirma |
| 4,979,672 | A | 12/1990 | AbuJudom, II et al. |
| 5,071,064 | A | 12/1991 | AbuJudom, II et al. |
| 5,206,775 | A | 4/1993 | Wilson |
| 5,306,957 | A | 4/1994 | Ellingham et al. |
| 5,397,869 | A | 3/1995 | Huen |
| 5,465,031 | A | 11/1995 | Nilssen |
| 5,603,141 | A | 2/1997 | Gledhill |
| 5,719,362 | A | 2/1998 | Gray, Jr. |
| 5,806,665 | A | 9/1998 | Houssian |
| 5,838,219 | A | 11/1998 | Du et al. |
| 5,955,796 | A | 9/1999 | Nilssen |
| 5,990,777 | A | 11/1999 | Whiteman, Jr. |
| 6,016,096 | A | 1/2000 | Barnes et al. |
| 6,036,330 | A | 3/2000 | Sanguedolce |
| 6,133,816 | A | 10/2000 | Barnes et al. |
| 6,218,995 | B1 | 4/2001 | Higgins et al. |
| 6,328,363 | B1 | 12/2001 | Larsen |
| 6,710,274 | B2 | 3/2004 | Whetzel et al. |
| 6,714,106 | B1 | 3/2004 | Czarnecki |
| 6,861,601 | B2 | 3/2005 | Heien |
| 7,189,936 | B2 | 3/2007 | Gray, Jr. |
| 2005/0194243 | A1 | 9/2005 | Prineppi |
| 2007/0193862 | A1 | 8/2007 | Blakeman |
| 2008/0047818 | A1 | 2/2008 | Holcomb |

REMOTE CONTROLLED WALL SWITCH ACTUATOR

CROSS-REFERENCE TO RELATED APPLICATIONS

This application is a continuation of U.S. patent application Ser. No. 11/044,552 filed on Jan. 25, 2005, now issued as U.S. Pat. No. 7,372,355, which claims the benefit of U.S. Provisional Application No. 60/539,551, filed on Jan. 27, 2004. The disclosures in the above applications are hereby incorporated by reference.

FIELD

The present invention generally relates to remote actuation of a switch and more particularly to actuation of a switch using shape memory alloys, while maintaining the ability to manually actuate the switch.

BACKGROUND

There are many specialty stores, publications and television programs about home improvement, renovation and construction. As a result, modern consumers are increasingly aware of advancements in technologies relating to the maintenance and operation of their homes. One increasingly popular trend in home technology concerns home automation wherein various devices can be controlled by remote actuation. Remote actuation allows the consumer to control the various devices beyond the reaches of any such device.

Typically, many devices are already controlled by switches and already integrated into the wiring of the building or location. One of the more prevalent examples may be a room light controlled by a conventional switch at the entrance to the room. It will be appreciated that many devices located in buildings or various locations, whether outside or inside, may be already controllable by conventional switches.

With reference to FIG. 1, a conventional wall switch is shown and generally indicated by reference numeral 10. A conventional double gang box is shown and generally indicated by reference numeral 12. The switch includes a mounting plate 14 and a switch lever 16. The mounting plate 14 is configured so that the switch 10 can be mounted to the gang box 12 by conventional methods. It will be appreciated that a second light switch (not shown) can be mounted by conventional methods to the gang box 12.

The configuration of the gang box 12 is typically standardized so that many different configurations of the wall switch 10 can be installed into the gang box 12, for example, lever switches, rocker switches, and/or dimmer switches, which may be collectively referred to as switch toggles. Nevertheless, many of the switches 10 generally conform to a set geometry, such that a distance 18 between each of the light switches 10 (one of which is shown) in the gang box 12 is standard and is about two inches (about 50 millimeters). It will be appreciated that if the gang box held more than two of the switches 10, the distance 18 between each of the switches 10 would be about the same.

The mounting plate 14 includes a first pair of apertures 20 and a second pair of apertures 22. The first pair of apertures 20 is configured so that the switch 10 may be secured to the gang box 12 with conventional fasteners 24. The second pair of apertures 22 is configured so that a switch cover (not shown) can be secured to the switch 10 with conventional fasteners (not shown). It will be appreciated that the double gang box 12 is configured to optionally contain two of the switches 10; therefore, the switch cover (not shown) can be configured to attach over two of the switches 10 by inserting conventional fasteners through the switch cover (not shown) into the second set of apertures 22.

The switch 10 may be configured with standard distances between the first pair of apertures 20 and the second pair of apertures 22. As such, the distance between the first pair of apertures 20 is about three and one-quarter inches (about 82 millimeters) and is indicated by reference numeral 26. The distance between the second pair of apertures 22 is about two and one-half inches (about 63 millimeters) and is indicated by reference numeral 28.

The switch lever 16 or switch toggle, in the conventional switch 10, opens and closes a circuit to which the switch 10 can be attached. The switch lever 16 in a first position typically corresponds to an "on" position. The on position refers to the switch 16 closing—thus completing—the circuit to which it is attached and ultimately delivering electricity to a device also on the circuit. The circuit, for example, could be a simple household power source connected to a lamp and the switch 10. The lamp may be plugged into a wall electrical socket that is controlled by the switch 10. With this arrangement, when the switch 10 is on or in the first position, the lamp will be on. When the switch 10 is off or in the second position, the light is turned off. It will be appreciated that when the switch lever 16 is in an up position, it is typically in the on position, which is also defined as the first position. As such, when the switch lever 16 is in a down position, it is typically in the off position, which is also defined as the second position.

The switch lever 16 contains a conventional spring (not shown) within the switch 10. As such, a force need not be applied to the switch lever 16 throughout the entire motion from the first position to the second position. The switch lever 16, therefore, need only be moved approximately 85% from one position toward another, as the spring will complete remaining motion.

The conventional switch 10 can be integrated into many applications such as residential, commercial or industrial buildings. The switch 10 can be electrically connected to many devices. As such, it is desirable to control any such device at a location beyond the reach of its respective switch. It also desirable to maintain the ability to manually actuate the switch 10 when in close proximity to the switch 10.

Implementations of remote switch actuators that are installed over, or in lieu of, conventional household switches have been very bulky and/or difficult to install. Some implementations require the consumer to replace a conventional light switch or cover up the light switch entirely with the remote actuator. Other implementations are configured so that the remote actuator is installed over an existing light switch where the lever extends through the actuator but still does not allow manual actuation of the light switch. The bulkiness of previous implementations has also not been visually appealing to the consumer as the bulkiness manifests itself in the large device extending from the wall.

Other implementations of remote actuators have included rather complex and expensive systems to actuate the light switch. Previous exemplary systems have included worm drive systems and/or various gear assemblies to actuate the light switch. These systems only allow the user to actuate the light switch with the remote control actuator and eliminate the ability to actuate the light switch manually. Other implementations have also resulted in a shorter battery life or the requirement to hardwire the remote actuator into the building electrical system to avoid the short battery life problem.

It is desirable to provide a remote actuation unit that does not rely on complex, bulky, and otherwise expensive gearing assemblies. It is also desirable to provide a slim and visually appealing package for the remote actuation device. It is additionally desirable to maintain the ability for the consumer to manually actuate the switch without regard to the position of the remote actuation device. It is also desirable to provide at least the above functionality and provide substantial battery life.

SUMMARY

In one form, the teachings of the present invention provide a device to actuate a switch. The switch has a switch toggle movable between a first position and a second position. The device includes a switch yoke movable between the first position and the second position adapted to engage the switch toggle and move therewith. The device also includes a first linkage connected to the switch yoke. The first linkage applies a force in response to an input signal to move the switch yoke from the first position to the second position. The first linkage includes a shape memory alloy.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description, the appended claims, and the accompanying drawings, wherein:

DETAILED DESCRIPTION

The following description of the preferred embodiments is merely exemplary in nature and is in no way intended to limit the invention, its application or uses.

Figure 1:
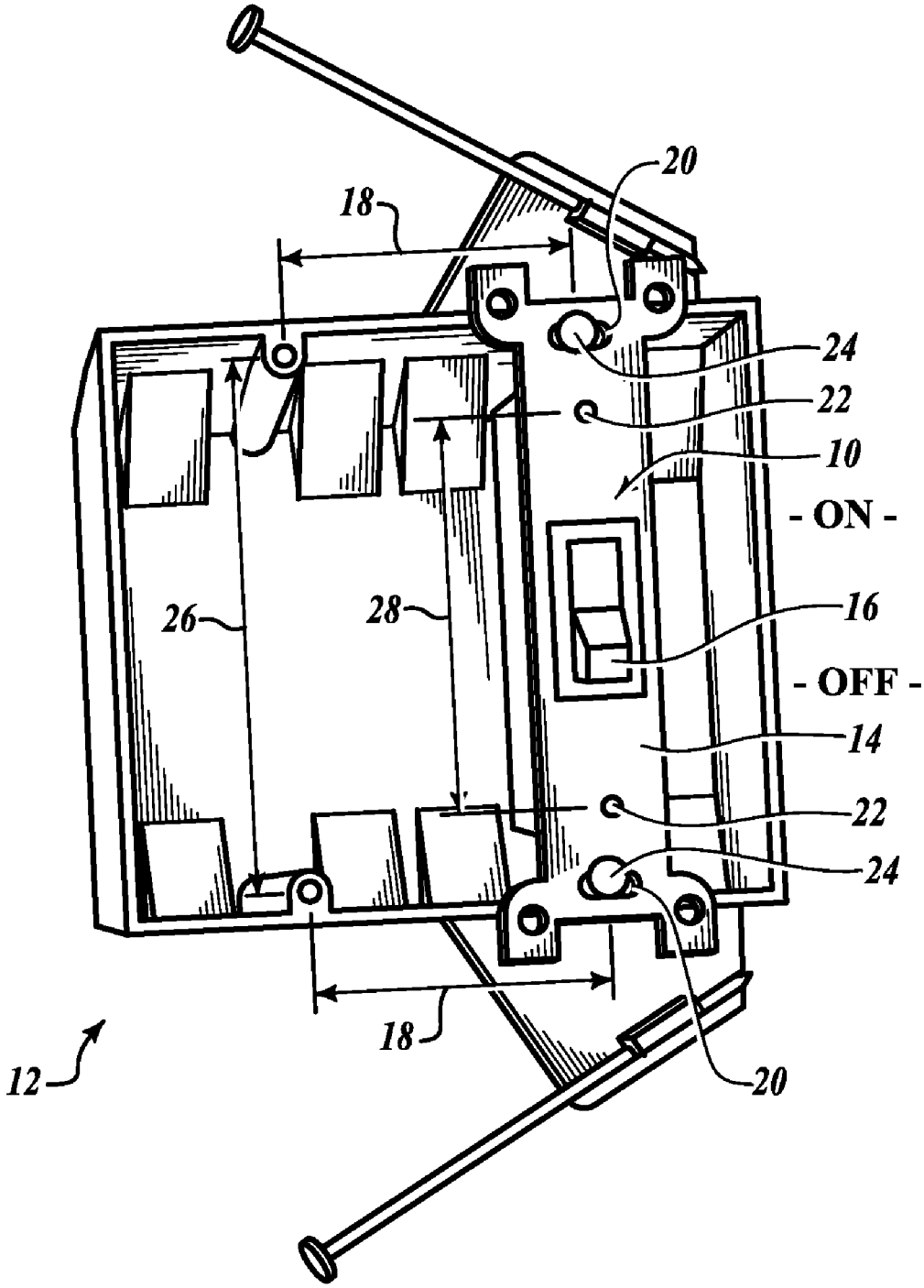
(PRIOR ART) FIG.1
FIG. 1 is a front view of a conventional switch mounted in a conventional double gang box.
Figure 2:
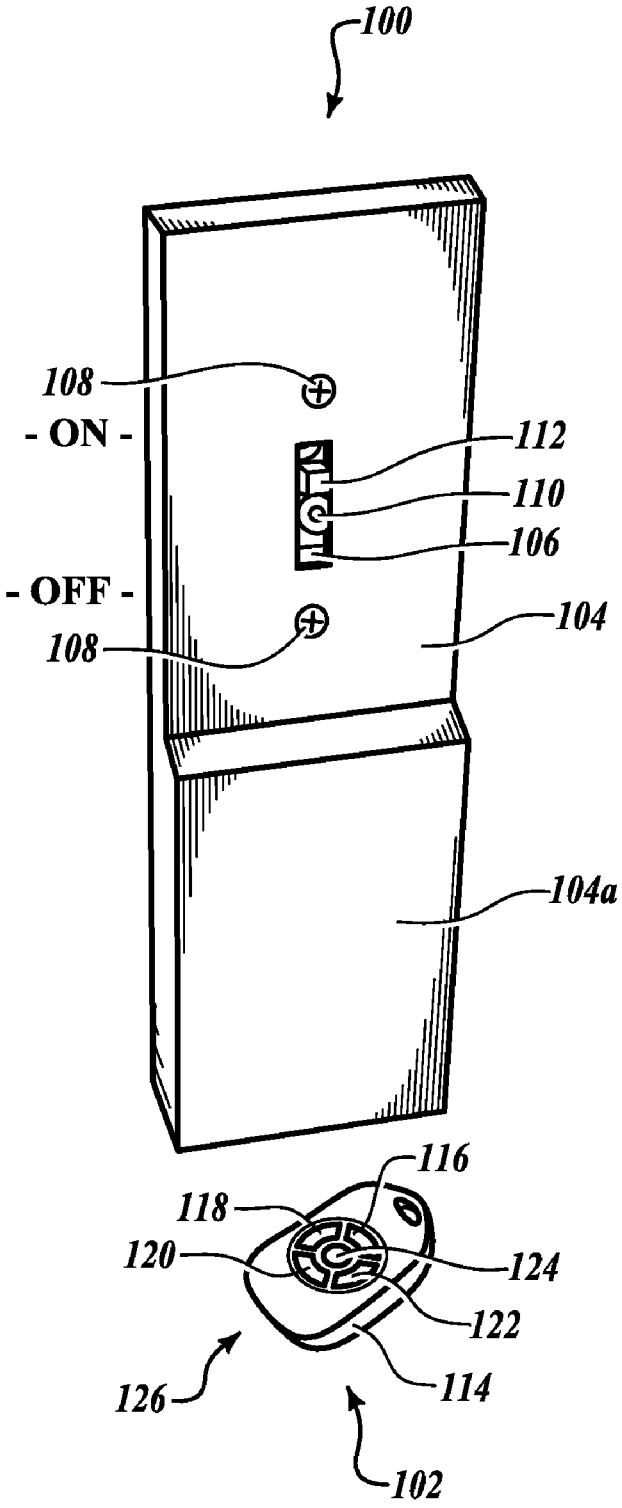
FIG. 2 is a front view of a remote controlled wall switch actuator and a remote transmitter constructed in accordance with the teachings of the present invention.

With reference to FIG. 2, a remote controlled wall switch actuator is generally indicated by reference numeral 100. A transmitter is generally indicated by reference numeral 102. The actuator 100 includes a housing 104, which encases internal components of the actuator 100. The housing 104 can be configured in many shapes, for example but not limited to those shown in FIG. 2, FIG. 3 and FIG. 11. The housing 104 also includes a removable power supply cover 104*a*. In various embodiments, the actuator 100 is sized to be secured over a single light switch 106, but it will be appreciated that the housing 104 may be sized in various configurations to fit over a single light switch or multiple light switches, as partially depicted in FIG. 1. Some exemplary configurations that secure over multiple light switches will be discussed below.

A pair of fasteners 108 can be used to secure the housing 104 to the light switch 106. It will be appreciated that the fasteners 108 may be used to secure the housing 104 to the switch 106 using the second pair of apertures 22 (FIG. 1) that are otherwise available to secure the conventional light switch cover (not shown) to the switch 106. It will also be appreciated that the fasteners 108 may also be used to secure the housing 104 to the switch 106 using the first pair of apertures 20 (FIG. 1) that is also used to secure the switch 106 to the conventional gang box 12 (FIG. 1). It will be appreciated that many methods exist to secure the actuator 100 to the conventional switch 106, some such exemplary methods including mechanical fastening, bonding, magnetic coupling and combinations thereof.

A switch yoke 110 may be partially visible through the housing 104. The switch yoke 110 is used to move a switch lever 112 or a switch toggle of the switch 106 from a first position to a second position. It will be appreciated that the first position may correspond with an "on" position of the switch 106 and a second position may correspond to an "off" position of the switch 106. It will be further appreciated that the "on" and "off" positions of the switch 106 are in reference to the conventional household switch 10 (FIG. 1). As such, the labels OFF and ON are depicted throughout the figures for clarity, but it will be appreciated that the first position and the second position need not correspond to the on position or the off position in other installations.

The transmitter 102 includes a remote transmitter housing 114, a first button 116, a second button 118, a third button 120, a fourth button 122 and a fifth button 124. The aforementioned buttons may be hereinafter collectively referred to as buttons 126. The first button 116 can be configured to control the actuator 100. As such, a user (not shown) may select the first button 116, which in turn will control the actuator 100 to move it from its current position to a new position, for example, if the actuator 100 is in the first position, selection of the first button 116 will control it to the second position. If the actuator 100 is in the second position, selection of the first button 116 will control the actuator 100 to the first position. It should therefore be noted that controlling the actuator 100 from the first position to the second position necessarily encompasses controlling the actuator 100 from the second position to the first position.

Either the first button 116, the second button 118, the third button 120, the fourth button 122 or the fifth button 124 can be configured to control the remote actuator 100. It will be appreciated that multiple remote controlled wall switch actuators 100 can be installed in a given location. If, for example, five actuators 100 were installed in a given location, the buttons 126 of the remote transmitter 102 may be individually assigned to control an associated one of the actuators 100. It will be further appreciated that the individual buttons 126 of the remote transmitter 102 may control multiple actuators 100, for example, the second button 118 may control three actuators 100 at once. In that example, selecting the second button 118 will control the three actuators 100, and if all of the actuators 100 are in the same position, selection of the second button 118 will control the actuators 100 to the other position. It follows that regardless of the position of the actuators 100, selection of the second button 118, in that example, will control the actuators 100 to the opposite position.

Those of ordinary skill in the art will appreciate from the disclosure that two of the buttons may be employed to control one of the actuators 100. For example, the actuator 100 may respond to a signal, which is generated by the transmitter 102 in response to the actuation of button 116, to cause the switch yoke 110 to move the switch lever 112 to the "on" position only if the switch lever 112 is not in the "on" position when the signal is generated. Similarly, the actuator 100 may also respond to a signal, which is generated by the transmitter 102 in response to the actuation of button 118, to cause the switch yoke 110 to move the switch lever 112 to the "off" position only if the switch lever 112 is not in the "off" position when the signal is generated.

It will be additionally appreciated that one or more of the buttons 126 can be configured, so that when selected control one or more actuators 100 from the first position to the second position. For example, the fourth button 122 can be configured to turn off all of the actuators regardless of the position of the actuator, such that some actuators may be in the second position and remain in the second position while others may be in the first position and will move to the second position. It follows, therefore, that one or more of the buttons 126 can be configured so that the actuator 100 responds by moving from the second position to the first position, such that some of the actuators may be in the first position and remain in the first position while others may be in the second position and will move to the first position.

Figure 3:
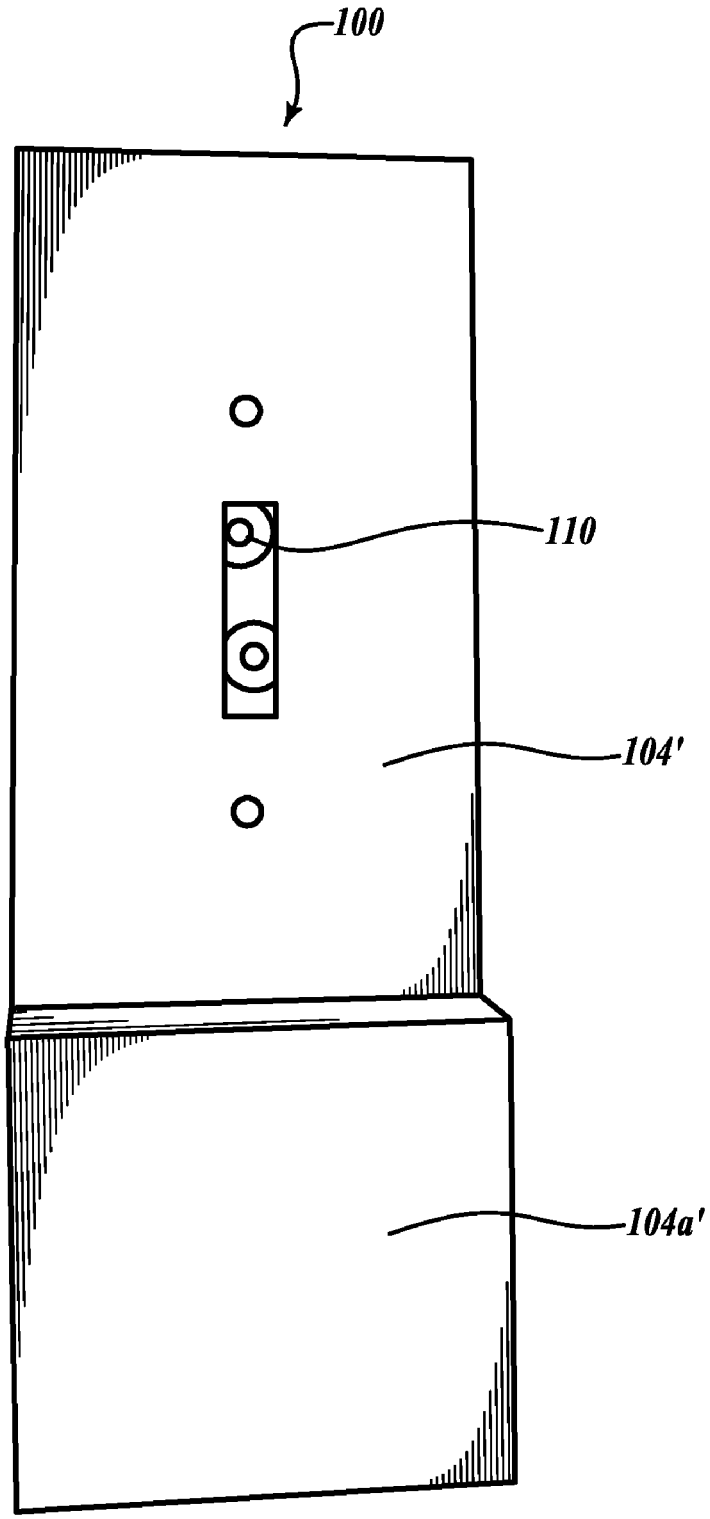
FIG. 3 is a front view of an alternate remote controlled wall switch actuator showing no switch installed.

With reference to FIG. 3, the remote controlled wall switch actuator 100 is shown with the housing 104 configured with a different decorative appearance indicated by reference numeral 104'. A removable power supply cover is indicated by reference numeral **104*a*'. Regardless of the housing 104' configuration or appearance, the actuator 100 can be sized to be secured over the single light switch 106 (FIG. 2) or multiple light switches, as partially depicted in FIG. 1**.

It will be appreciated that the housing 104 may be configured to fit over the single switch or multiple switches. To that end, multiple housings may be attached to multiple switches or a larger housing may be attached to the multiple switches. It will be further appreciated that in applications where the larger housing is used to actuate multiple switches, the power supply, the actuation assembly and the controller module will be modified to accommodate the additional switches.

Figure 4:
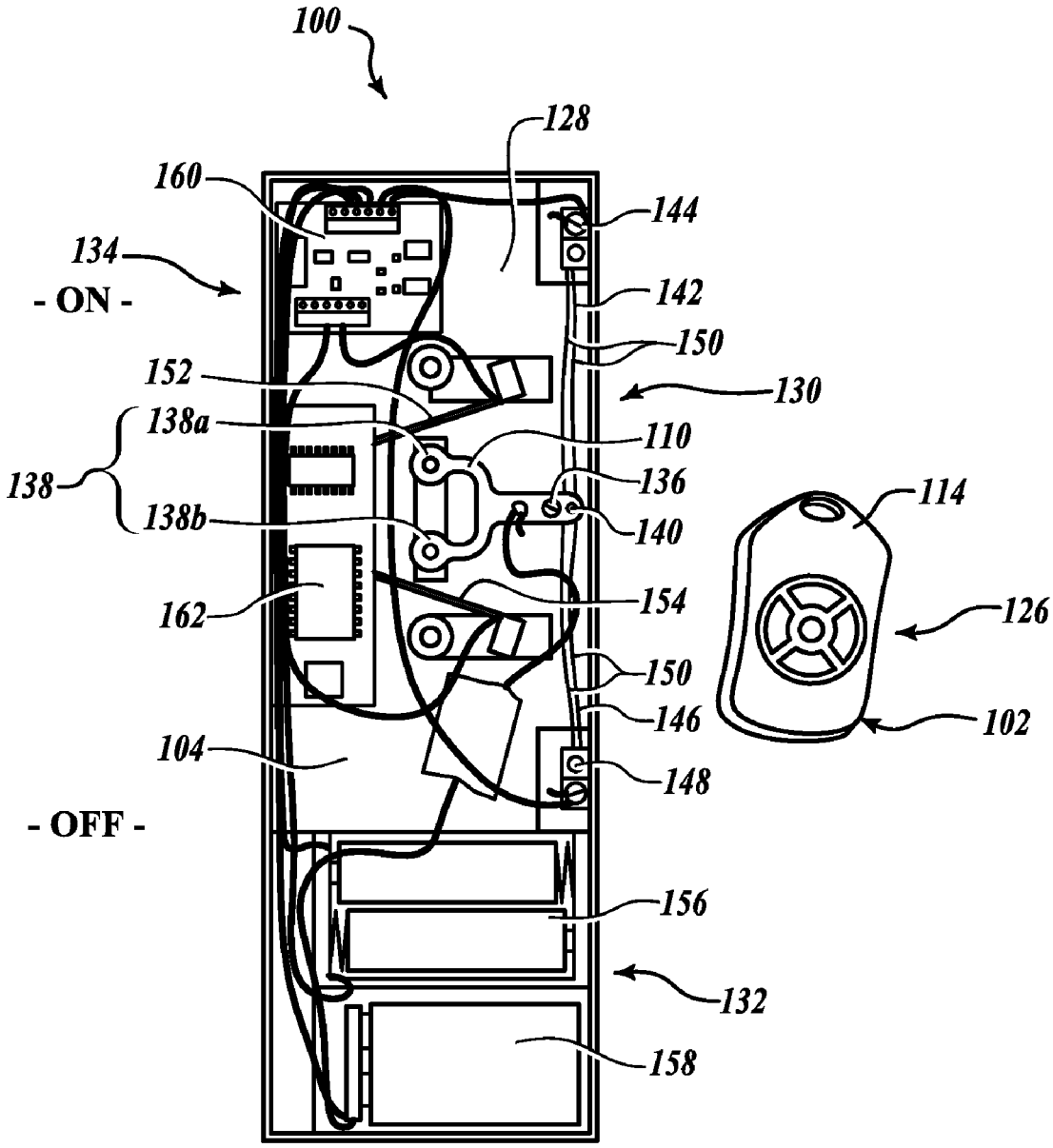
FIG. 4 is an internal view of FIG. 2 showing internal components of the wall switch actuator.

With reference to FIG. 4, the exemplary internal components of the actuator 100 are shown along with the remote transmitter 102. In the various embodiments, a rear portion 128 of the housing 104 is shown containing the exemplary internal components of the actuator 100, which includes an actuation assembly 130, a power supply 132 and a controller module 134. The actuation assembly 130 includes the switch yoke 110 that pivots on a pivot point 136. The switch yoke 110 includes a first contact point **138*a* and a second contact point 138*b*; hereinafter collectively referred to as contact points 138. The contact points 138 are configured to make contact with the switch lever 112 (FIG. 2**).

On the switch yoke 110, opposite the rounded contact points 138, is a linkage contact point 140. A first linkage 142 connects a first post 144 to the linkage contact point 140. A second linkage 146 connects a second post 148 to the linkage contact point 140. The first linkage 142 and the second linkage 146 are comprised of at least one shape memory alloy wire 150. The first linkage 142 and the second linkage 146 may be comprised of two shape memory alloy wires 150.

The shape memory alloy wire 150 is available from many sources and in many configurations; as such, various compositions and dimensions of the wire 150 may be used in the actuator 100. In the various embodiments, the wire 150 can be a nitinol wire obtained from Dynalloy, Inc (Costa Mesa, Calif.) under the trade name Flexinol®. The wire 150 begins to constrict when heated above its transformation temperature, which is about 194 degrees Fahrenheit (about 90 degrees Celsius). The wire 150 will begin to cool and resort to its relaxed condition when its temperature drops below the transformation temperature.

In the embodiment illustrated, the two wires 150 have a diameter of about 0.008 inches each (about 0.2 millimeters) and apply about 1.3 pounds (about 5.8 Newtons) of force each when they are heated above their transformation temperature. It will be appreciated that thicker wires can be used to apply the same force but inherent in a larger diameter wire is a longer relaxation time, hence a longer cooling time. It will be appreciated that this is due to a smaller ratio of surface area to cross-sectional area, relative to several thinner wires. As such, two thinner wires may apply the same force as a single thicker wire but cool faster, or varying size wires may be used to apply a suitable force with a suitable relaxation time.

The actuator 100 may also include a first position-sensing switch 152 and a second position-sensing switch 154. The switch yoke 110 may be configured to make contact with the first position-sensing switch 152 when the switch yoke 110 is in the first position. In turn, the switch yoke 110 may also be configured to make contact with the second position-sensing switch 154 when the switch yoke 110 is in the second position. It will be appreciated that when the switch yoke 110 is in the first position, the linkage contact point 140 has pivoted away from the first post 144 and that when the switch yoke 110 is in the second position, the linkage control point has pivoted away from the second post 148.

It will be appreciated that the actuator 100 can be manually actuated regardless of the position of the switch yoke 110. It will be further appreciated that manual activation refers to the user moving the switch lever 112 independent of any control of the actuator 100. As such, when the switch lever 112 is moved to a first position, the switch yoke 110 will move to a first position and thus make contact with the first position-sensing switch 152. It follows, therefore, that when the switch lever 112 moves to the second position, the switch yoke 110 makes contact with the second position-sensing switch 154.

Even when the switch 106 is manually actuated, the actuator 100 detects the position of the switch 106. The actuator 100, therefore, when activated will move the switch 106 from its current position to a new position. For example, if the user (not shown) moves the switch 106 to the first position from the second position and then the actuator 100 is activated, the actuator 100 will move the switch 106 from the second position to the first position. It will be appreciated therefore, that the actuator 100 can be used to actuate the switch 106 remotely without any manual actuation of the switch 106. With the actuator 100 installed, the switch 106 can also be used exclusively via manual actuation. The switch 106 can also be actuated manually from the first position to the second position and then return to the first position using the actuator 100. It follows that the actuator 100 can move the switch 106 from the first position to the second position and then the switch 106 can be manually actuated back to the first position.

With continuing reference to FIG. 4, the actuator 100 includes the power supply 132. In the various embodiments, the power supply 132 includes a three-volt power source 156 and a nine-volt power source 158. The power supply 132 provides power to the controller module 134, which in turn controls the actuation assembly 130. The controller module 134 contains a processor 160 and a remote control receiver module 162. The three-volt power source 156 provides power to the processor 160, while the nine-volt power source 158 provides power to the remote control receiver module 162. It will be appreciated that the power supply 132 may be configured with a single voltage power supply to supply both the processor 160 and the remote control receiver module 162. While individual batteries are shown in FIG. 4, it will also be appreciated that the power supply 132 may be configured with rechargeable batteries, hard-wired into the home power supply with or without suitable transformers, or provided with various other power supply configurations.

In the control module 134, the processor 160 is configured to control the actuator 100. The remote control receiver module 162 is configured to receive radio frequency (RF) transmissions from the remote transmitter 102. It should be appreciated that the remote transmitter 102 is only one type of transmitter that can be used to activate the actuator 100 by sending an input signal. Other such input signals to activate the actuator 100 can be sent from motion sensors, proximity sensors, timers, light sensors or any combination of these devices.

With reference to FIGS. 5A, 5B, 5C, and 5D the actuator 100 is shown in a simplified form and generally indicated by reference numeral 100'. The switch yoke 110 is connected to the first linkage 142 and the second linkage 146 at the linkage contact point 140. The first linkage 142 connects to the first post 144 and the second linkage 146 connects to the second post 148. The first post 144 includes a first latch circuit 164 and a first driver 166. The second post 148 includes a second driver 168 and a second latch circuit 170. The switch yoke 110, when in the first position, makes electrical contact with the first position-sensing switch 152, and in the second position makes electrical contact with the second position-sensing switch 154.

The processor 160 is connected to the remote control receiver module 162, which may receive the input signals from many sources. Some sources that can send input signals may be, for example, the remote transmitter 102, a timer 172, a light sensor 174 or a motion or proximity sensor 176 all of which can send an input signal via RF communication 178. It will be appreciated that the processor 160 can be configured to receive signals directly from the remote transmitter 102, the timer 172, the light sensor 174, or the motion or proximity sensor 176 or other logic components can be configured to receive the same signals and direct them to the processor 160. Regardless of the source of the input signal, the remote control receiver module 162 responds to the input signal by generating an actuation signal. It will be appreciated, however, that the either the timer 172, the light sensor 174, or the motion or the proximity sensor 176 may be integral to the actuator 100 or may be installed remotely and send signals to the actuator via RF communication 178 or any other suitable form of electromagnetic wave communication. It will also be appreciated that the processor 160 can be configured as a single or multiple integrated circuit controllers or multiple logic components.

The remote control receiver module 162 may also be configured to receive an audio input signal such as a clapping sound or a voice command. It will be appreciated that the actuator may be close enough to a user to receive audio input, but still may be far enough away where manual actuation is not possible. To that end, the actuator 100 can be configured to receive audio inputs and thus generate the actuation signal.

The remote control receiver module 162 may also be configured to receive an input signal through a home automation system, such as through household electrical system using the X10® protocol. The remote control receiver module 162 may also be configured to receive signals from a universal remote control. Integration of the X10® protocol and use of universal remote controls are more fully discussed in commonly assigned U.S. patent application Ser. No. 10/697,795, titled Home Automation system, and filed Oct. 30, 2003, which is hereby incorporated by reference as if fully set forth herein.

Figure 5A:
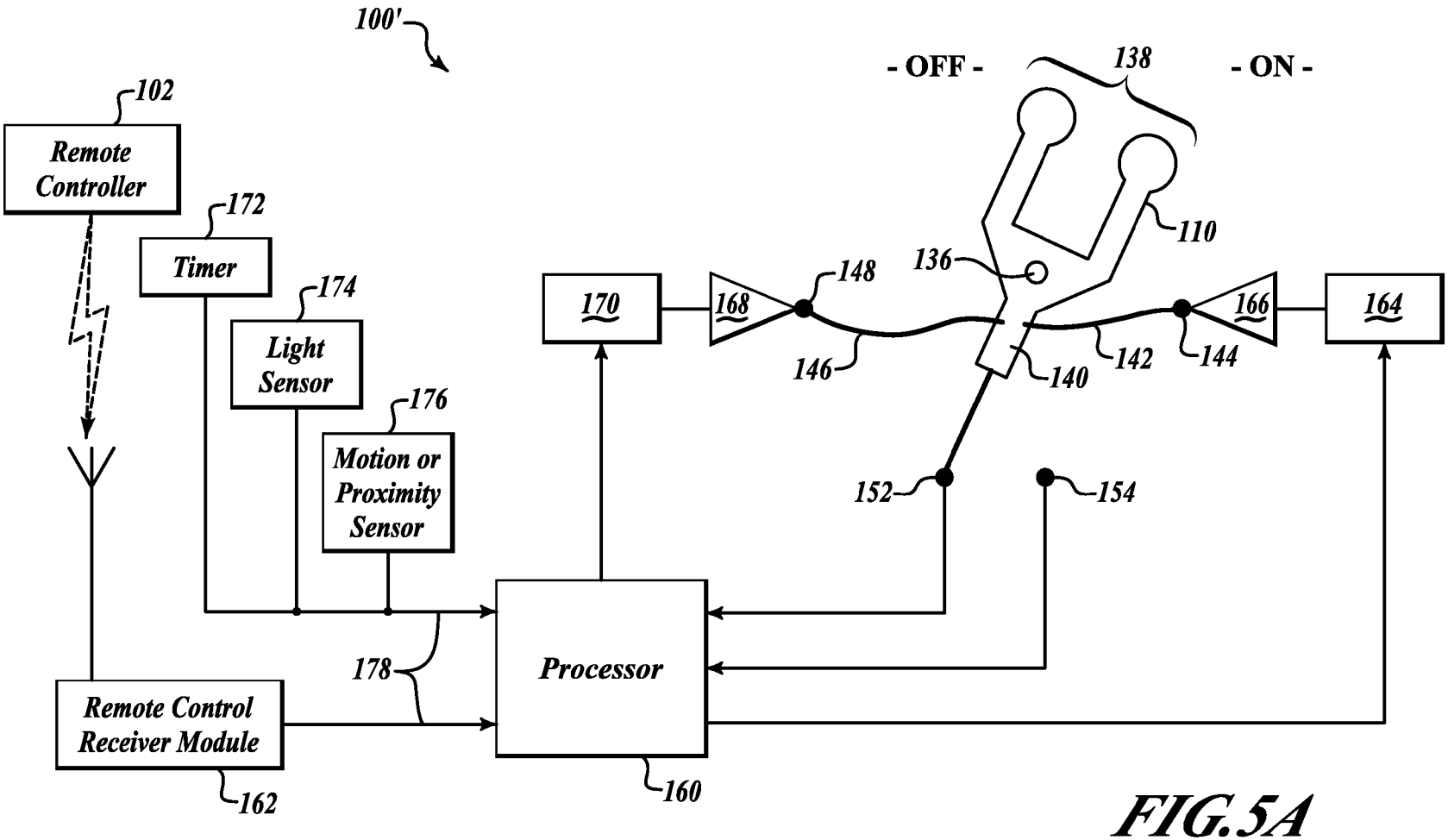
FIG. 5A is a simplified representation of FIG. 4 showing a switch yoke in the first position, a first linkage in a relaxed condition, and a second linkage in a relaxed condition.
Figure 5B:
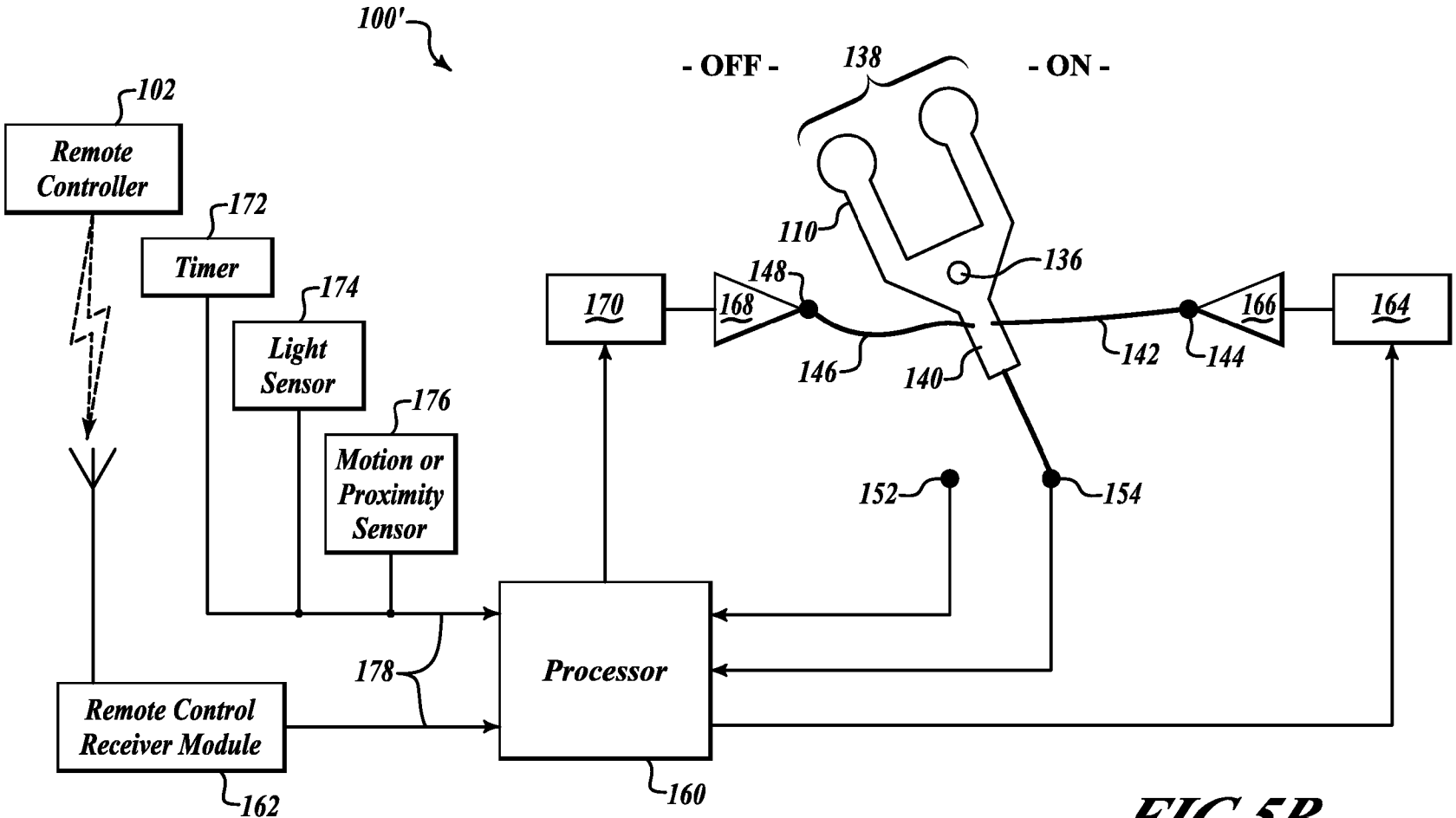
FIG. 5B is a view similar to FIG. 5A but showing the switch yoke in a second position, the first linkage in a constricted condition, and the second linkage in the relaxed condition.

With reference to FIG. 5A, the switch yoke 110 is shown in the first position. The first linkage 142 and the second linkage 146 are in rest condition. Upon receipt of the input signal, the remote control receiver module 162 sends an actuation signal to the processor 160. The processor 160, in turn, causes the actuator 100 to move the switch lever 112 (FIG. 2) from the first position to the second position, which typically turns the switch 106 (FIG. 2) off, as depicted in FIG. 5B.

In the various embodiments, this is accomplished by the processor 160 sending a signal to the first latch 164. The first latch 164 activates the first driver 166, resulting in the driver 166 heating the first linkage 142. Heating of the shape memory alloy wires 150 (FIG. 4) in the first linkage 142, causes the first linkage 142 to constrict and apply a force to the switch yoke 110. The force applied to the switch yoke 110 causes the switch yoke 110 to move from the first position to the second position, as shown in FIG. 5B.

Once the switch yoke 110 reaches the second position and makes contact with the second position-sensing switch 154, the processor deactivates the first driver 166. The first driver 166 will remain on until the switch yoke 110 moves into the second position and makes contact with the second position-sensing switch 154, or until a maximum actuation time has elapsed. In the various embodiments, the maximum actuation time can be about one second. If the driver has been on for more than the maximum actuation time and the yoke has not completed the motion from the first to the second position, the processor turns off the driver. The processor will turn off the driver, in this scenario, to prevent possible damage to the actuator 100.

The processor 160, after sending a signal to the first latch 164, will not send any more signals for a predetermined lock-out time. The lock-out time may be about five seconds. The lock-out time may include an actuation time, a shape memory alloy relaxation time and a system delay. The actuation time refers to the time it takes to move the switch yoke between the first position and the second position when the actuator 100 is actuated. The shape memory alloy relaxation time refers to the time it takes for the shape memory alloy wire to cool after being heated. In the particular example provided, the actuation time is about one second, the shape memory alloy relaxation time is about two and one half seconds, and the system delay is about one second. It will be appreciated that changes to the shape memory alloy, system geometry, or various other design changes may necessitate changes to either the actuation time, the shape memory alloy relaxation time or the system delay.

With reference to FIG. 5B, the switch yoke 110 is shown in the second position. The first linkage 142 is taut, as it is still in a constricted condition from being heated by the first driver 166. The second linkage 146 is in a relaxed condition. With the switch yoke 110 in the second position, the switch yoke 110 makes electrical contact with the second position-sensing switch 154. The processor 160 detects the switch yoke 110 in the second position by detecting the contact between the switch yoke 110 and the second position-sensing switch 154. If the first driver 166 is still on, the processor 160 will turn off the first driver 166 and the first linkage 142 will begin to cool. As the first linkage 142 cools, both the first linkage 142 and the second linkage 146 will be in a relaxed condition, as shown in FIG. 5C.

Figure 5C:
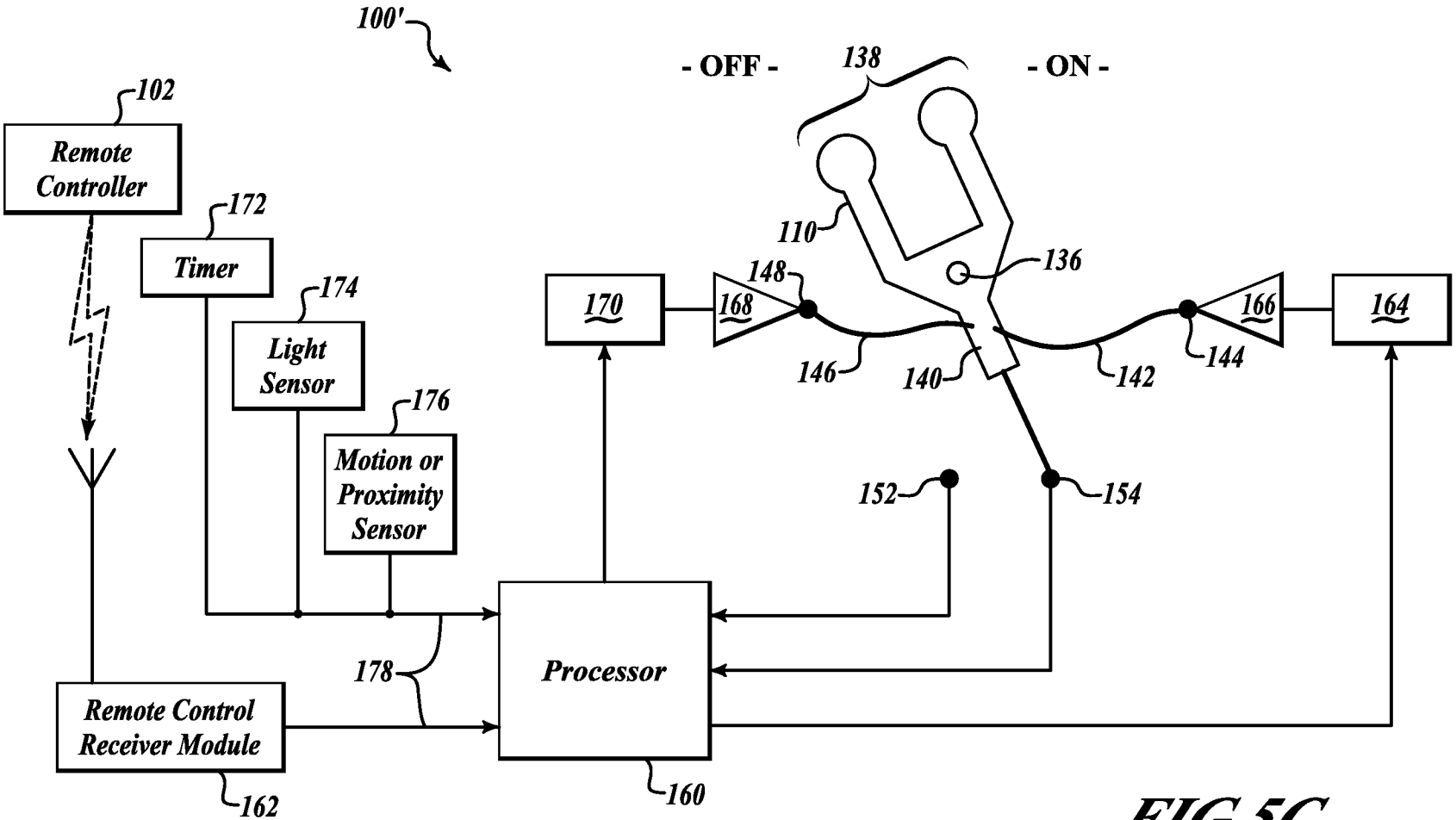
FIG. 5C is a view similar to FIG. 5A but showing the switch yoke in the second position, the first linkage in the relaxed condition, and the second linkage in the relaxed condition.

With reference to FIG. 5C, the switch yoke 110 is shown in the second position. The first linkage 142 and the second linkage 146 are in a relaxed condition. Upon receipt of the input signal, the remote control receiver module 162 sends an actuation signal to the processor 160, which in turn causes the actuator 100 to move the switch lever 112 (FIG. 2) from the second position to the first position, which typically would turn the switch 106 (FIG. 2) on, as shown in FIG. 5D.

In the various embodiments, this is accomplished by the processor 160 sending a signal to the second driver 168, which heats the second linkage 146. Heating of shape memory alloy wires 150 (FIG. 4) in the second linkage 146, causes the second linkage 146 to constrict and apply a force to the switch yoke 110. The force applied to the switch yoke 110 causes the switch yoke 110 to move from the second position to the first position, which is shown in FIG. 5D.

Once the switch yoke 110 reaches the first position and makes contact with the first position-sensing switch 152, the processor deactivates the second driver 168. The processor 160, after sending a signal to the second driver 168, will not send any more signals for the predetermined lock-out time.

Figure 5D:
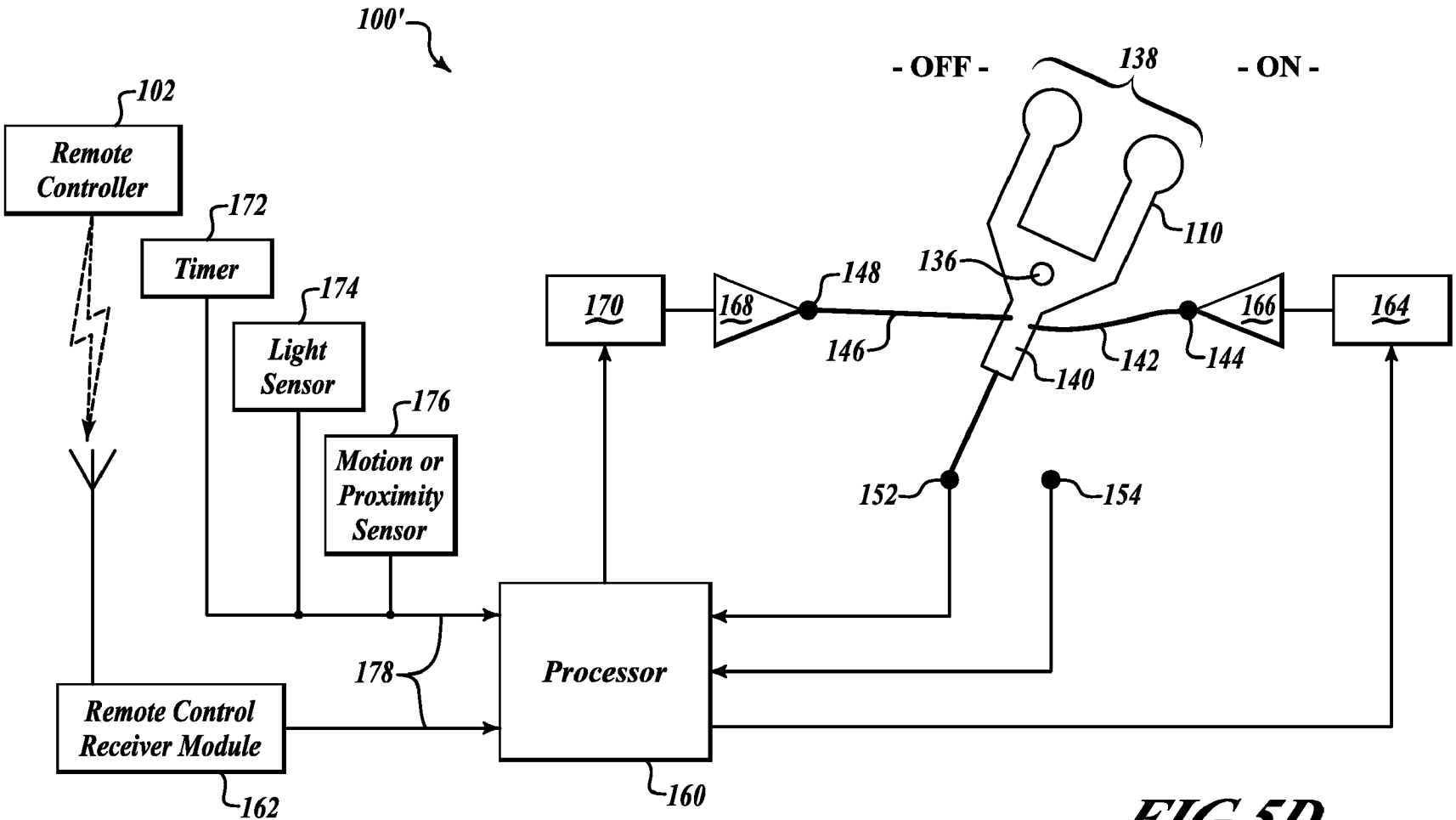
FIG. 5D is a view similar to FIG. 5A but showing the switch yoke in the first position, the first linkage in the relaxed condition, and the second linkage in the constricted condition.

With reference to FIG. 5D, the switch yoke 110 is shown in the first position. The second linkage 146 is taut, as it is still in a constricted condition from being heated by the second driver 168. The first linkage 142 is in a relaxed condition. With the switch yoke 110 into the first position, the switch yoke 110 has made electrical contact with the first position-sensing switch 152. The processor 160 detects the switch yoke 110 in the first position by detecting the contact between the switch yoke 110 and the first position-sensing switch 152. If the second driver 168 is still on, the processor 160 will turn off the second driver 168 and the second linkage 146 will begin to cool. As the second linkage 146 cools, both the first linkage 142 and the second linkage 146 will resort to the relaxed condition, as shown in FIG. 5A.

It will be appreciated that various designs of the components can be incorporated into the processor or configured as separate components. For example, the processor provides, among other things, a timing circuit to turn off and on the driver. One skilled in the art will appreciate that various processors can be configured to provide the functionality of a discrete logic component that functions as a timing circuit. On the other hand, discrete logic components can be configured to accomplish the same task whether or not a processor is utilized.

Figure 6:
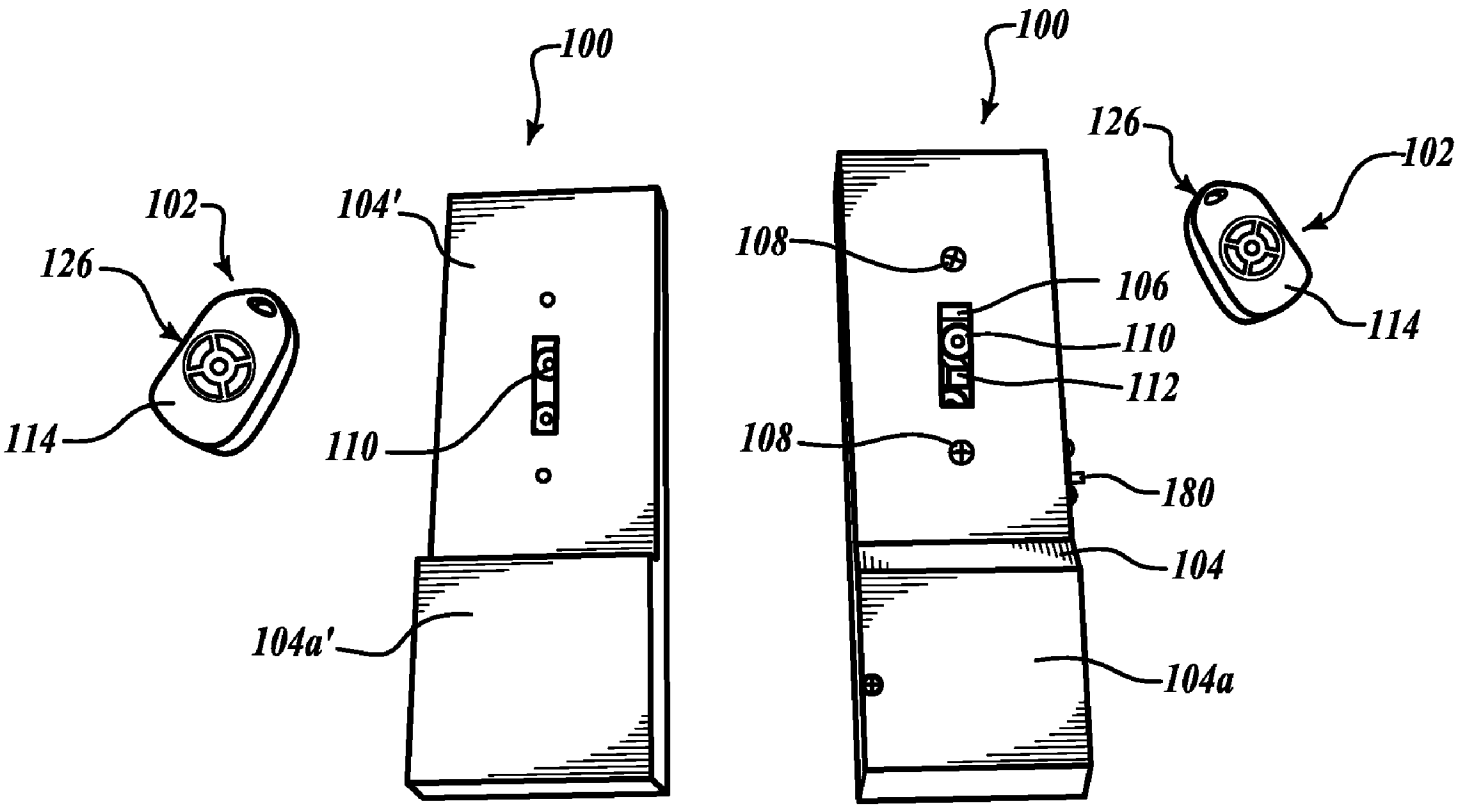
FIG. 6 is a front view of the actuator and the remote transmitter of FIG. 2.

With reference to FIG. 6, two actuators 100 are shown with two transmitters 102. Two configurations of the housing 104 and 104' are shown, along with two configurations of the removable power supply cover 104*a* and 104*a*'. The switch yoke 110 is partially visible through the housing 104 and 104'. The switch yoke 110 is shown engaged with the switch lever 112 in one of the actuators. An optional on/off switch 180 is shown, which is configured to disconnect the actuator 100 from the power supply 132, when switched off. Switching off the on/off switch 180 necessarily turns off the remote control receiver module 162, which is the only component that uses power unless the actuator 100 is activated.

Figure 7:
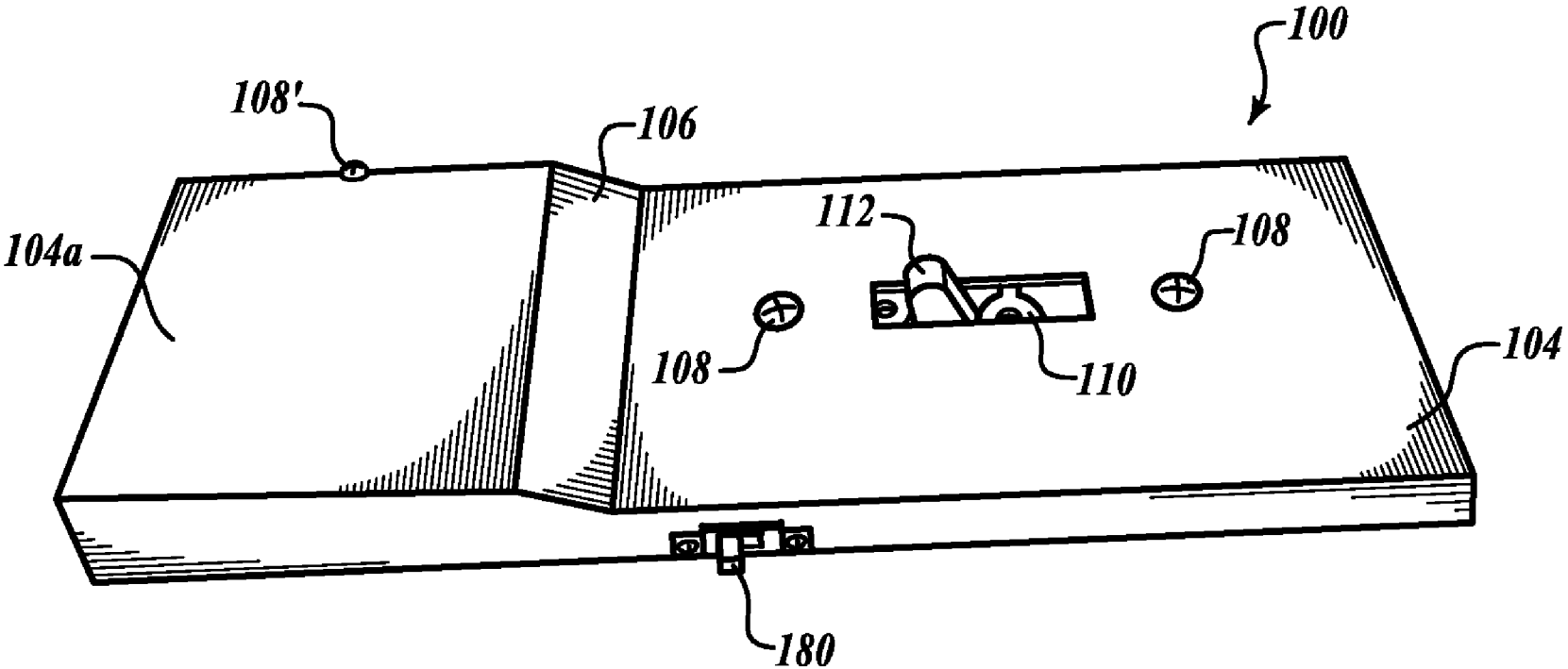
FIG. 7 is a perspective view of an actuator similar to the actuator of FIG. 2 but including an optional on/off switch.

With reference to FIG. 7, the actuator 100 is shown including the housing 104 and the removable power supply cover 104*a*. The optional on/off switch 180 is also shown. The switch yoke 110 is partially visible through the housing 104. The switch yoke 110 is shown engaged with the switch lever 112. An additional fastener 108' is shown to additionally secure the removable power supply cover 104*a* to the housing 104.

Figure 8:
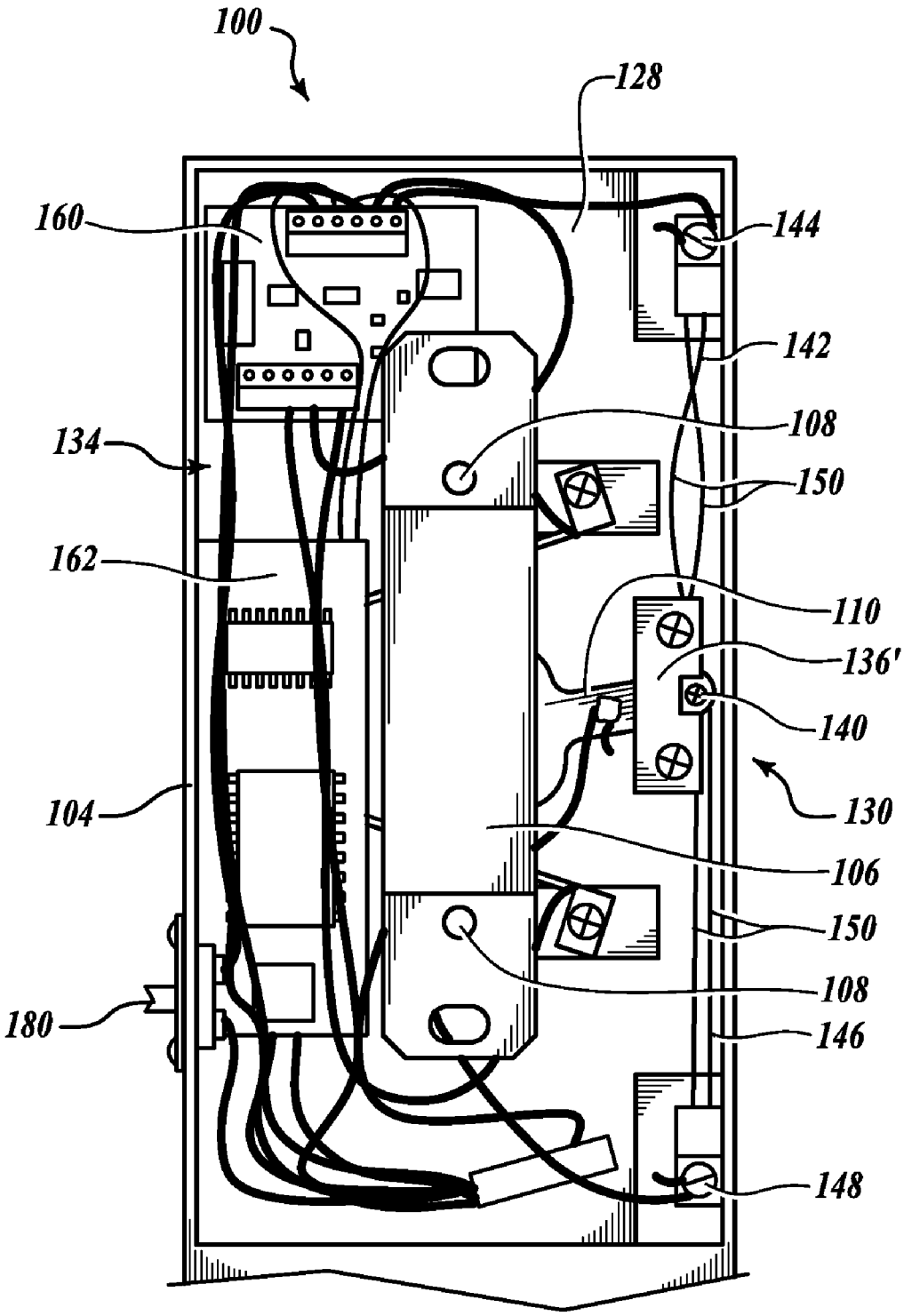
FIG. 8 is an enlarged view of a portion of the internal view of FIG. 4 showing the switch installed in the actuator.

With reference to FIG. 8, a partial rear view of the actuator 100 is shown with the switch 106 installed. The fasteners 108 are shown secured to the second pair of apertures 22 (FIG. 1). Portions of the actuation assembly 130 are shown including the switch yoke 110 that pivots on an alternatively configured pivot point 136'. The first linkage 142 is shown connecting the linkage contact point 140 on the switch yoke 110 to the first post 144. The second linkage 146 connects the second post 148 to the linkage contact point 140.

Figure 9:
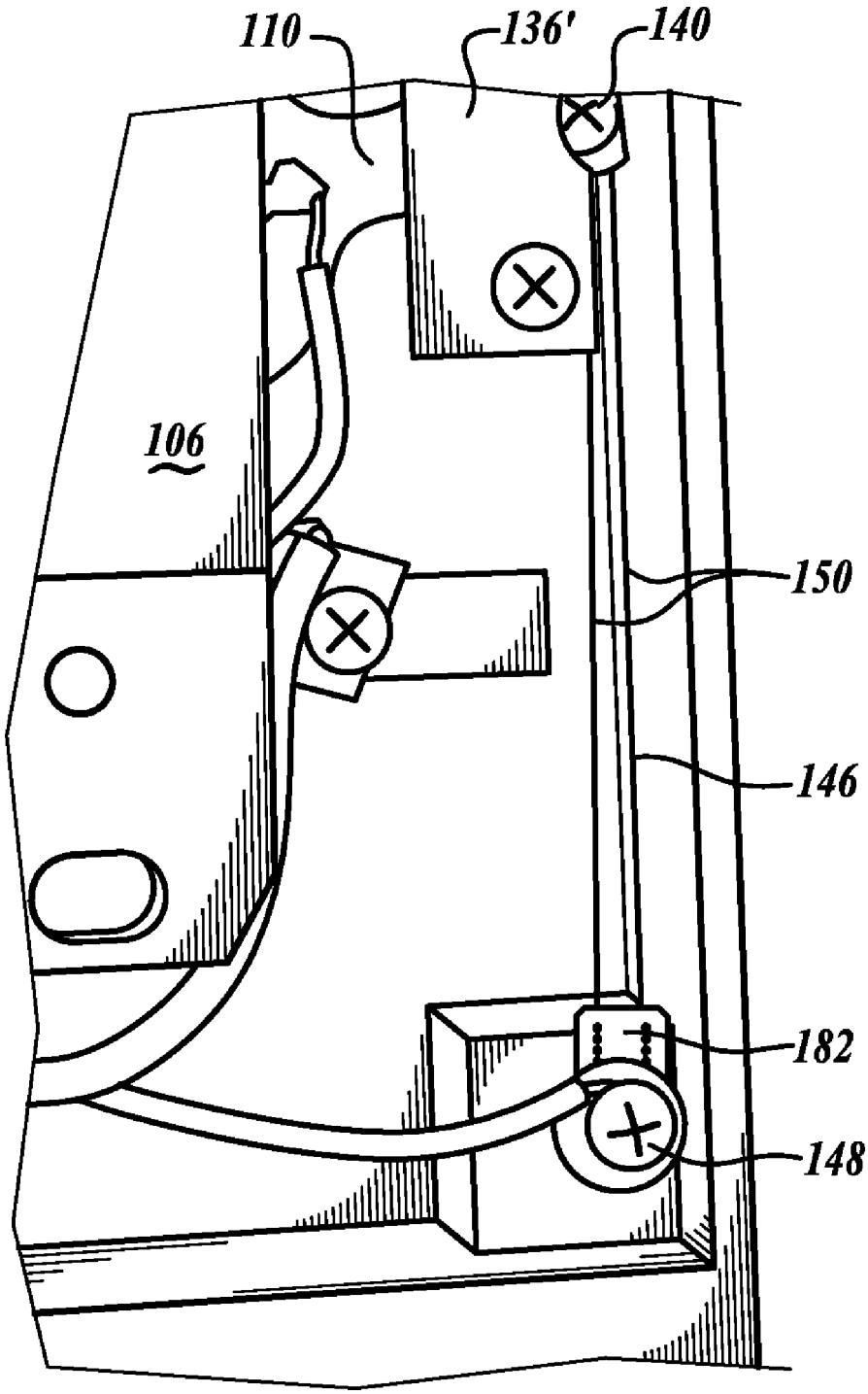
FIG. 9 is an enlarged view of a portion of FIG. 8 illustrating the second post and shape memory alloy wires connected thereto in greater detail.

With reference to FIG. 9, a partial rear view of the actuator 100 is shown with the switch 106 installed. The second post 148 is shown with the second linkage 146 woven into a second post attachment point 182.

Figure 10:
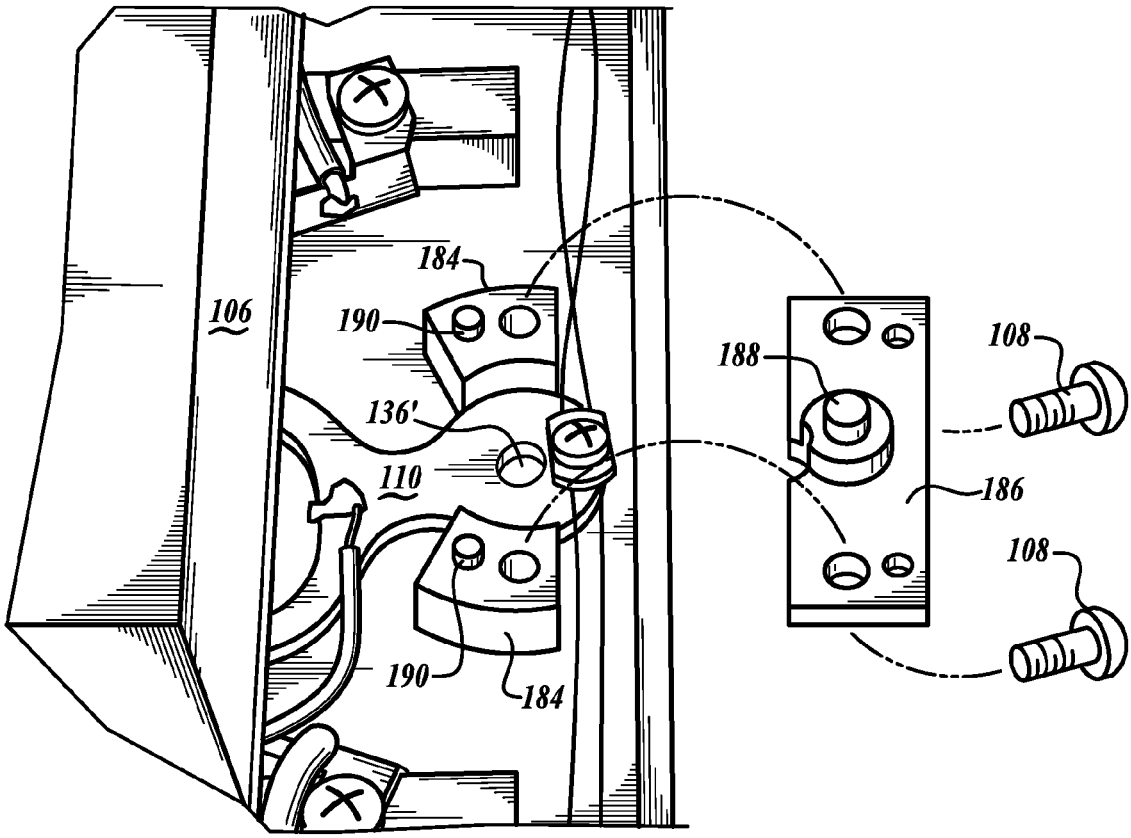
FIG. 10 is an enlarged view of a portion of FIG. 8 showing the linkage connection point and the pivot point on the switch yoke in greater detail.

With reference to FIG. 10, a partial rear view of the actuator 100 is shown with the switch 106 installed. The alternatively configured pivot point 136' is shown disassembled. The pivot point 136' includes a pair of opposed flanges 184 that capture switch yoke 110 but still allow it to pivot. A cap 186 has a middle post 188 that secures the switch yoke 110, when the cap 186 is secured to the pair of the opposed flanges 184 with the conventional fasteners 108. The pair of opposed flanges also have pins 190 that mate with the cap 186, when the cap 186 is secured to the opposed flanges 184.

Figure 11:
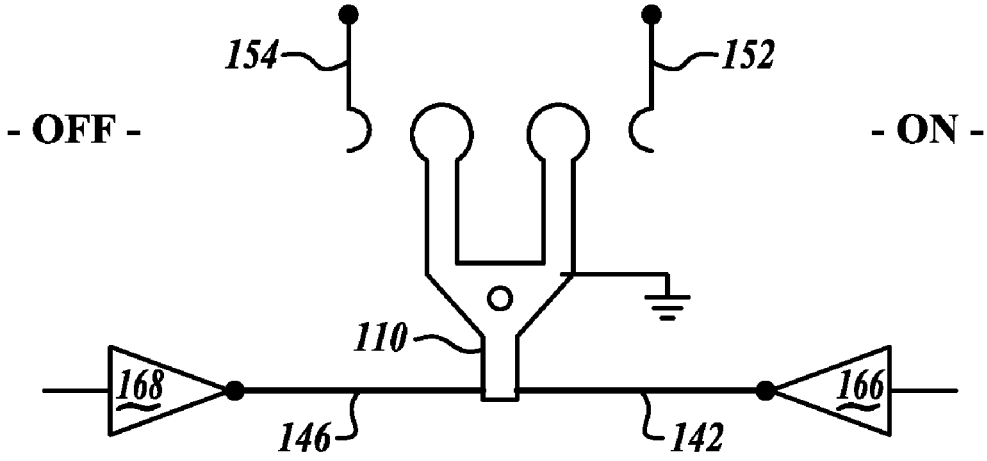
FIG. 11 is a simplified representation of FIG. 4 showing a grounded switch yoke and the respective linkages and position-sensing switches.

In the various embodiments, the remote controlled wall switch actuator can be electrically connected in various ways. In FIG. 11, for example, the switch yoke 110 is shown electrically connected to the first linkage 142 and the second linkage 146. The switch yoke 110 is at electrical ground, so that when the switch yoke 110 is in the first position it makes electrical contact with the first position-sensing switch 152. Power to either linkage flows through the switch yoke 110 to ground to complete the circuit. Upon switching to either the first or the second position, the switch yoke 110 contacts either position-sensing switch, thus grounding the position-sensing switch. When the position-sensing switch goes to ground, it can be interpreted as one logical state, such as logical zero or low.

Figure 12:
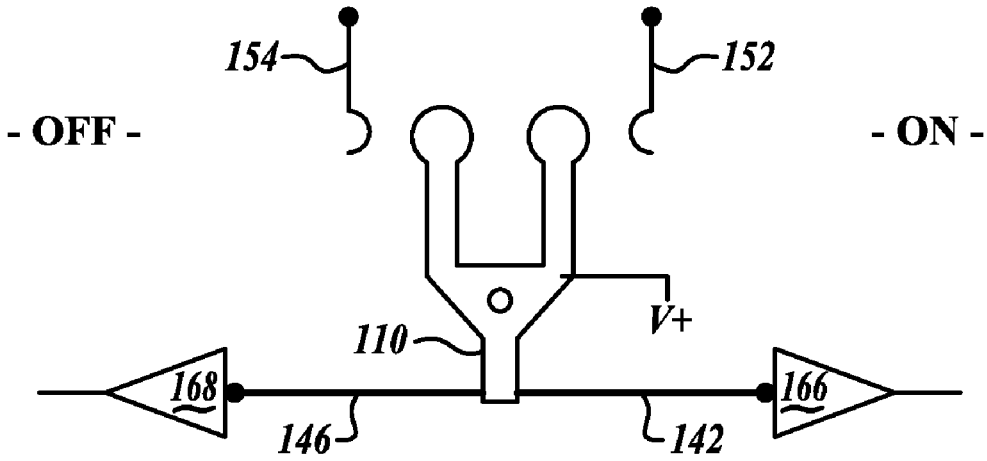
FIG. 12 is a view similar to that of FIG. 11 but showing switch yoke at a supply voltage, the respective linkages, and position-sensing switches.

With reference to FIG. 12, the switch yoke 110 is electrically connected to a supply voltage, for example three volts. Each linkage electrically connects the switch yoke 110 to the respective drivers to complete the circuit. When the switch yoke contacts either position-sensing switch, it changes the voltage at the position-sensing switch to, for example three volts, which can be interpreted as one logical state such as logical one or high.

Figure 13:
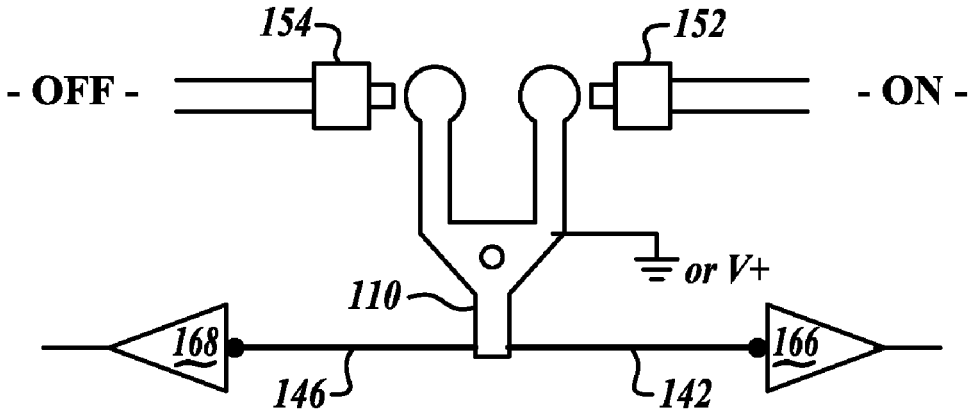
FIG. 13 is a view similar to that of FIG. 11 but showing a switch yoke, the respective linkages, and alternative position-sensing switches.

With reference to FIG. 13, the switch yoke 110 is electrically connected to ground or a supply voltage, as shown in FIGS. 11 and 12 respectively. When the switch yoke contacts either position-sensing switch, it mechanically activates one of the position sensing switches by making contact with that switch. Unlike FIGS. 11 and 12, a sensing voltage does not flow through the switch yoke 110. As such, contact with the first position-sensing switch 152, for example, can notify the processor that the switch yoke 110 has moved into the first position.

Figure 14:
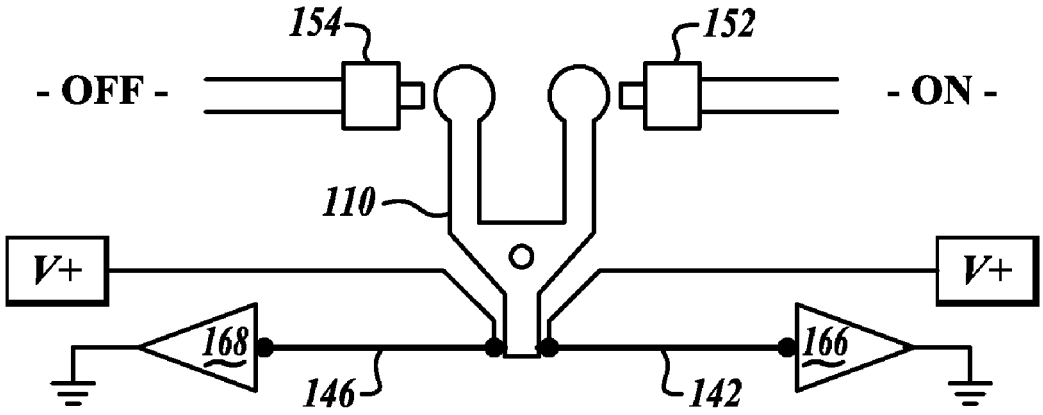
FIG. 14 is a view similar to that of FIG. 11 but showing an electrically isolated switch yoke, the respective linkages, and the alternative position-sensing switches.

With reference to FIG. 14, the switch yoke 110 is electrically isolated from the sensing voltage and the linkages. When the switch yoke 110 contacts either position-sensing switch, it mechanically activates one of the position sensing switches by making contact with that switch. Unlike FIGS. 11, 12, and 13, the sensing voltage neither flows through the switch yoke 110 nor are the linkages electrically connected to the switch yoke 110. As such, contact with the first position-sensing switch 152 can notify the processor 160 (FIG. 5A) that the switch yoke 110 has moved into the first position. It will be appreciated that the switch yoke 110 could also be electrically isolated from the linkages but make electrical contact with the position-sensing switches as shown in FIGS. 11 and 12 or other combinations thereof.

Figure 15:
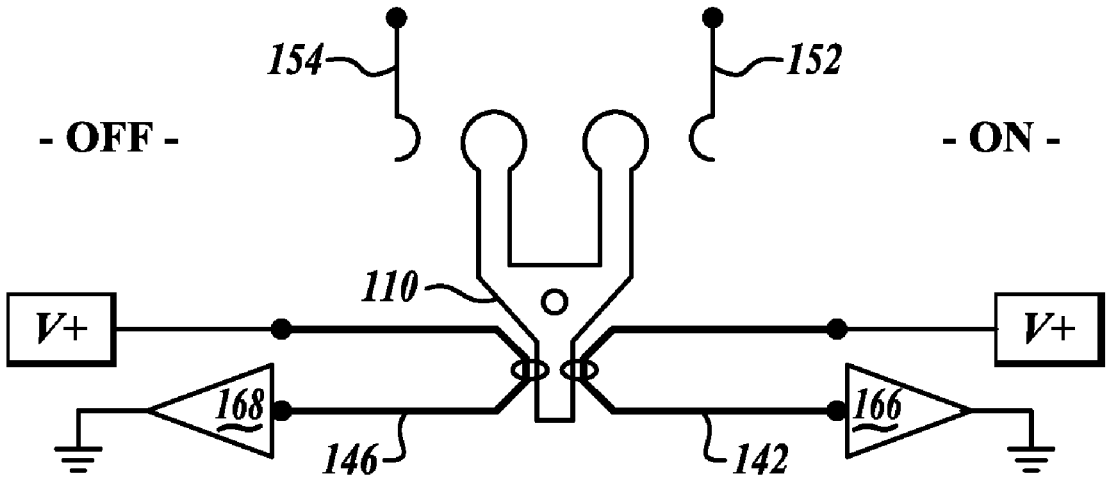
FIG. 15 is a view similar to that of FIG. 11 showing the switch yoke, the respective alternative linkages, and the position-sensing switches.

With reference to FIG. 15, the switch yoke 110 is electrically connected to ground or a supply voltage, as sown in FIGS. 11 and 12 respectively. When the switch yoke contacts either position-sensing switch, it changes the voltage at the position sensing switch to, for example, zero or three volts, which can be interpreted as zero or one, respectively, or low or high, respectively as mentioned above. As such, contact with the first position-sensing switch 152, for example, can notify the processor the switch yoke 110 has moved into the first position. The switch yoke 110 is electrically insulated from the linkage wires, which are configured in a doubled-over configuration. The doubled-over configuration provides a mechanical advantage when the linkage pulls the switch yoke 110. Furthermore, the wires of the linkage are longer, rather than two wires connected in parallel, to increase the resistance over the wire. The higher resistance allows a for reduced peak current draw from the battery (FIG. 4), which may in turn increase battery life. Less current draw may also allow for the use of less-expensive components. It will be appreciated that wires of the linkage could be configured with multiple wires, where the wires act mechanically in parallel, but are electrically connected in series.

Figure 16:
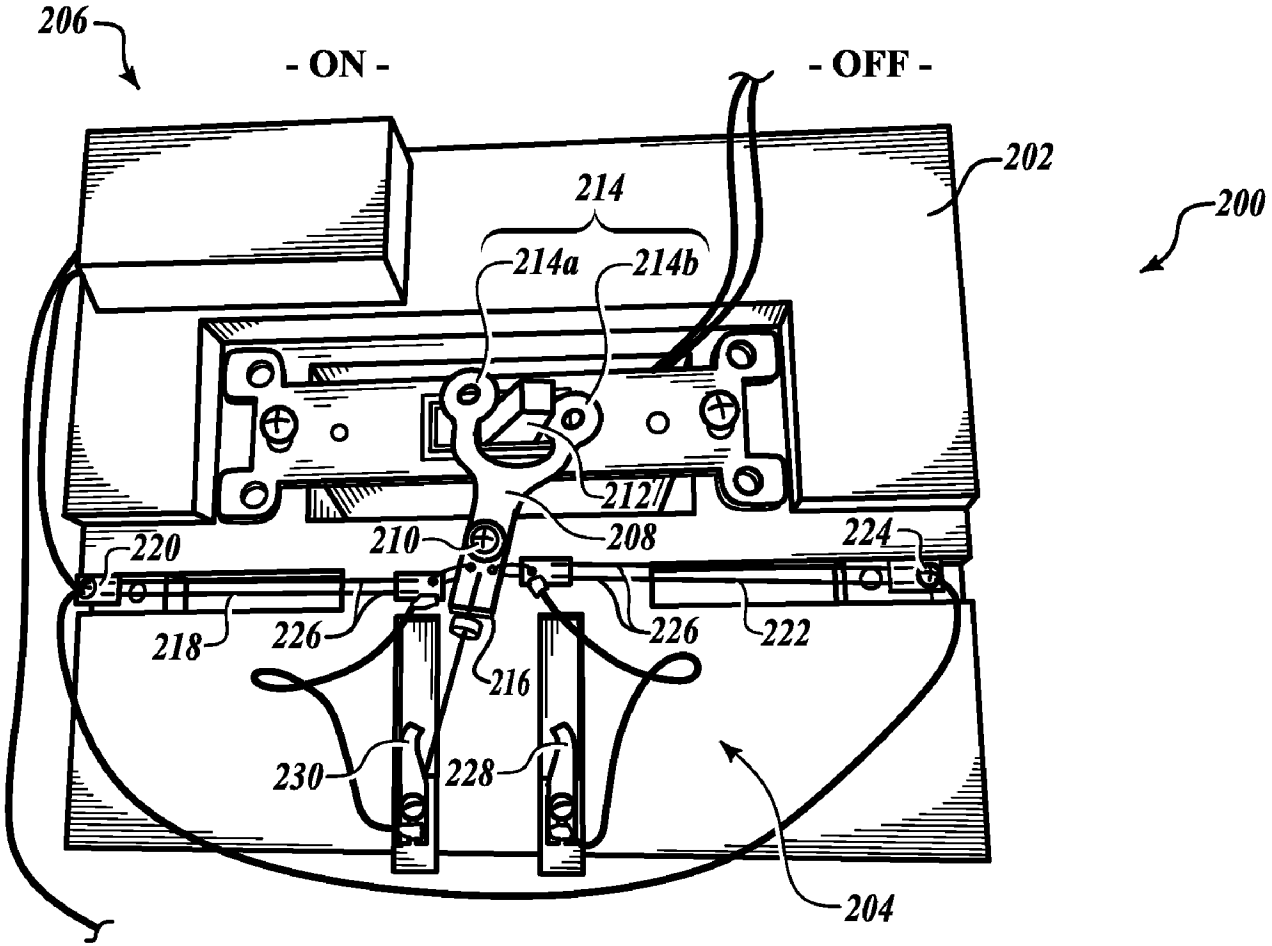
FIG. 16 is a front view of an alternative embodiment of the remote controlled wall switch actuator constructed in accordance with the teachings of the present invention.

With reference to FIG. 16, another embodiment of a remote controlled switch actuator is shown and generally indicated by reference numeral 200. A housing 202 is shown including the exemplary internal components of the actuator 200, which includes an actuation assembly 204 and a power supply 206. The actuation assembly 204 includes a switch yoke 208 that pivots on a pivot point 210. The switch yoke 208 and a switch lever 212 or switch toggle are shown in the second position. The switch yoke 208 includes a first contact point 214*a* and a second contact point 214*b* collectively referred to as contact points 214. The contact points 214 are configured to make contact with the switch lever 212.

On the switch yoke 208, opposite the contact points 214, is a linkage contact point 216. A first linkage 218 connects a first post 220 to the linkage contact point 216. A second linkage 222 connects a second post 224 to the linkage contact point 216. The first linkage 218 and the second linkage 222 are comprised of at least one shape memory alloy wire 226. In the various embodiments, the first linkage 218 and the second linkage 222 are comprised of two shape memory alloy wires 226.

The actuator 200 also includes a first position-sensing switch 228 and a second position-sensing switch 230. The switch yoke 208 is configured to make contact with the first position-sensing switch 228 when the switch yoke 208 is in the first position. In turn, the switch yoke 208 is also configured to make contact with the second position-sensing switch 230 when the switch yoke 208 is in the second position. It will be appreciated that while the configuration of the actuator 200 is different from the actuator 100, many aspects of the functionality remain the same. As such, the actuator 200 can be manually actuated regardless of the position of the switch yoke 208.

Figure 17:
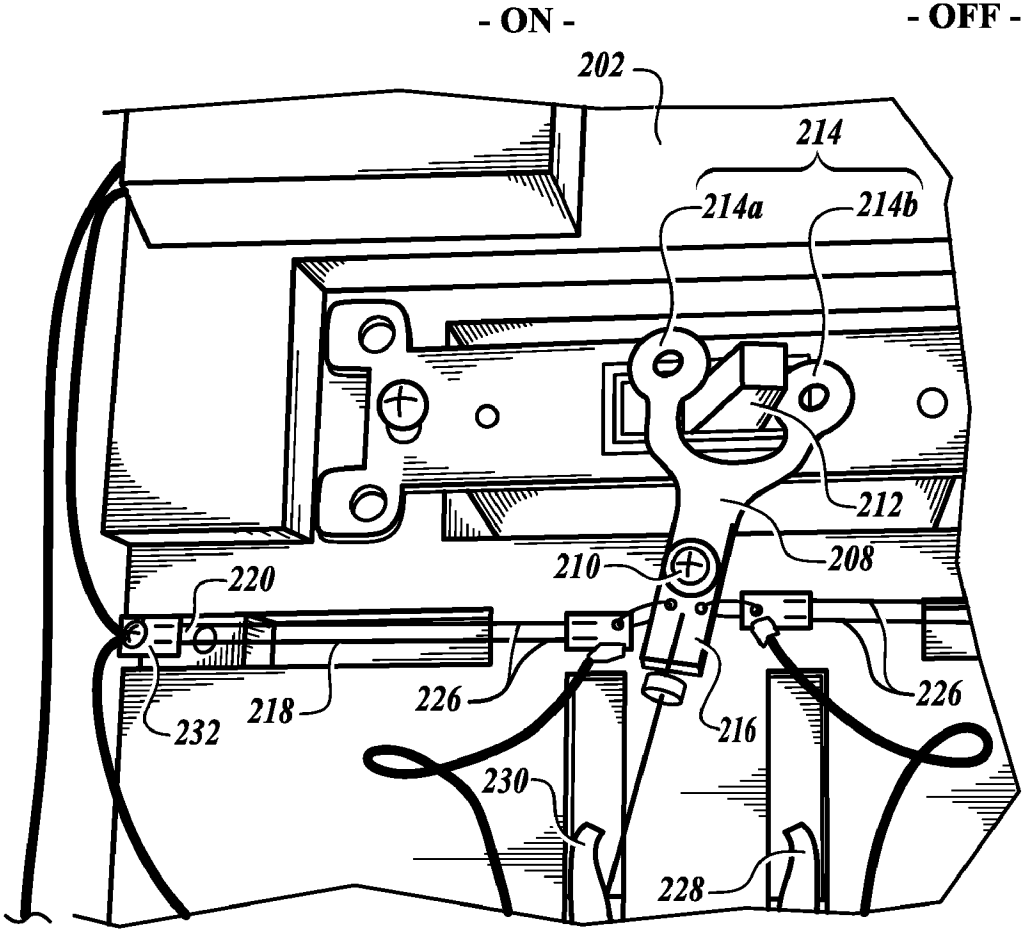
FIG. 17 is an enlarged view of a portion of FIG. 16 showing the linkage connection point, the pivot point, and the switch yoke in greater detail.

With reference to FIG. 17, a partial rear view of the actuator 200 is shown with the switch lever 212 in the second position. The first post 220 is shown with the first linkage 218 woven into a first post attachment point 232.

Figure 18:
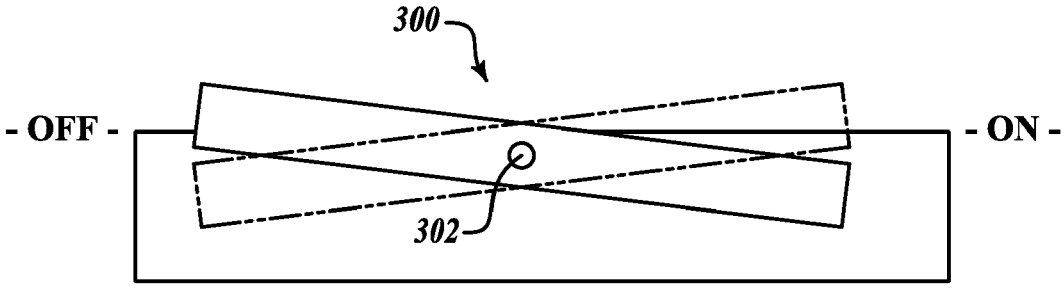
(PRIOR ART) FIG.18
FIG. 18 is simplified view of a conventional rocker switch.
Figure 19:
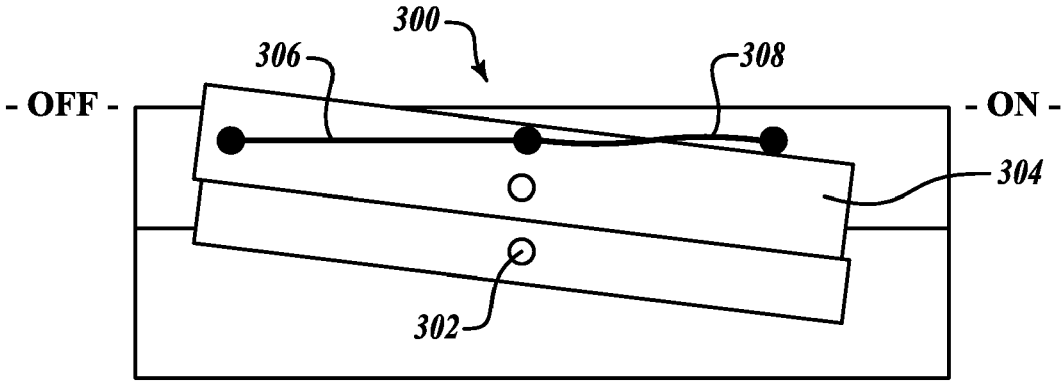
FIG. 19 is simplified view of another alternative embodiment of the remote controlled wall switch actuator constructed in accordance with the teachings of the present invention, the switch actuator being shown in operative association with the conventional rocker switch such that the rocker switch is placed in the first position.
Figure 20:
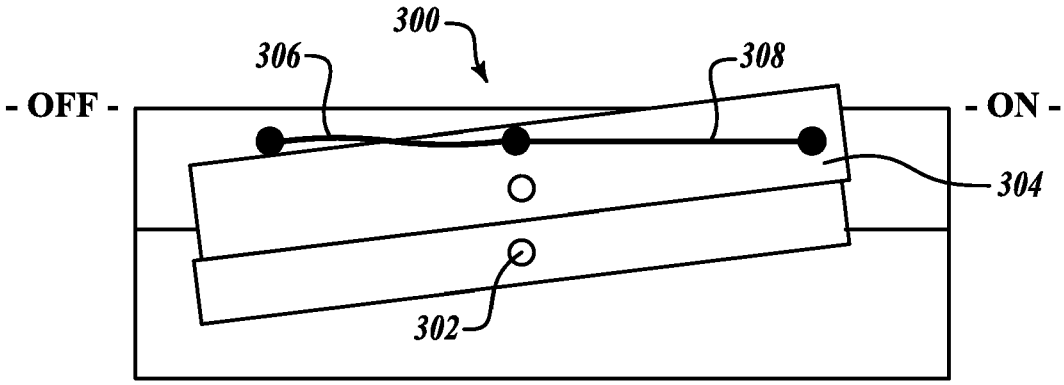
FIG. 20 is a view similar to that of FIG. 19 but illustrating with the rocker switch in the second position.

With reference to FIG. 18, a conventional rocker switch is generally indicated by reference numeral 300. The rocker switch 300 moves about a pivot 302. With reference to FIGS. 19 and 20, a remote-controlled wall switch actuator 304 is placed over the rocker switch 300 to provide remote actuation of the rocker switch 300. Similar to the functionality of the remote-controlled wall switch actuator 100 (FIG. 4), the respective linkages can be constricted to move the rocker switch 300 from a first position to a second position.

In various embodiments, a first linkage 306 constricts to move the rocker switch 300 to the first position, as shown in FIG. 19. A second linkage 308 constricts to move the rocker switch 300 to the second position, as shown in FIG. 20. As the linkages constrict, the remote-controlled wall switch actuator 304 presses against the rocker switch 300 to move it into position. As such, the remote-controlled wall switch actuator 304 is similar in configured similarly to the remote-controlled wall switch actuator 100 except that it is configured to connect with a rocker-style wall switch 300.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A switch cover device that fits over an installed switch having a switch toggle movable between a first position and a second position, the switch cover device comprising:

a housing that defines an aperture that receives the switch toggle;

a switch yoke pivotally coupled to said housing, said switch yoke engages the switch toggle of the installed switch and moves with the switch toggle between the first position and the second position;

a first linkage connected between said housing and said switch yoke that applies a force in a first direction when the switch toggle is in the second position and in response to an input signal received by the switch cover device, said force from said first linkage in said first direction moves the switch toggle to the first position a second linkage connected between said housing and said switch yoke that applies a force in a second direction opposite said first direction when the switch toggle is in the first position in response to an input signal received by the switch cover device, said force from said second linkage in said second direction moves the switch toggle to the second position, said first linkage and said second linkage are slack unless applying a force in response to said input signal so the switch cover device remains operable to permit the installed switch to complete remaining motion of the switch toggle toward the first or the second positions.

2. The device of claim 1 further comprising: a timer that sends said input signal upon expiration of a period to move the switch toggle to the second position that corresponds to the installed switch being in an off condition.

3. The device of claim 1 further comprising: a motion detection sensor that sends said input signal upon detection of motion to move the switch toggle to the first position that corresponds to the installed switch being in an on condition.

4. The device of claim 1 further comprising: a timer and a motion detection sensor that send said input signal upon no detection of motion after an expiration of a period to move the switch toggle to the second position that corresponds to the toggle switch being in an off condition.

5. The device of claim 1, wherein said housing has a pair of apertures spaced apart a dimension defining a distance about equal to a distance between a pair of apertures on the installed switch, wherein said pair of apertures are adapted to receive fasteners that secure an original cover to the installed switch.

6. The device of claim 5, wherein said housing has a cover having a front surface and a back surface, wherein said cover of said housing defines said pair of apertures through which fasteners pass to secure the switch cover device to the installed switch, wherein said switch yoke is behind said cover adjacent said back surface and wherein said switch yoke is disposed between said cover and the installed switch.

7. The device of claim 1 further comprising: a remote control that produces said input signal.

8. A method of using a switch cover device on an installed switch having a switch toggle movable between a first position and a second position, the method comprising:

disposing the switch cover device over the installed switch so the switch toggle extends through a housing of the switch cover device and into a switch yoke, said switch yoke is movable with the switch toggle between the first and the second positions;

actuating the switch toggle manually without a force generated by the switch cover device so the switch toggle moves said switch yoke as the switch toggle is manually moved between the first and the second positions;

applying a force on a first side of the switch toggle from the switch cover device to said switch yoke when said switch yoke is in the second position and a signal is received by the switch cover device so said switch yoke moves the switch toggle to the first position;

applying a force on a second, opposite side of the switch toggle from the switch cover device to said switch yoke when said switch yoke is in the first position so said switch yoke moves the switch toggle to the second position when a signal is received by the switch cover device;

permitting said switch yoke to move with the switch toggle as the installed switch completes the remaining motion of the switch toggle toward the first position or the second position when the switch toggle is neither in the first position or in the second position.

9. The method claim 8 further comprising: securing the switch cover device to the installed switch with fasteners operable to secure the existing switch cover to the installed switch.

10. The method of claim 8, wherein the switch toggle is in the first position and said signal is indicative of an expiration of a time period to cause said switch yoke to move the switch toggle to the second position, wherein the second position of the switch toggle corresponds to the installed switch being in an off condition.

11. The method of claim 8, wherein the switch toggle is in the second position and said signal is indicative of motion detected by a motion detection sensor detects motion, wherein the second position of the switch toggle corresponds to the installed switch being in an on condition.

12. The method of claim 8, wherein the switch toggle is in the first position and said signal is indicative of an expiration of time and the lack of motion detected by a motion detection sensor, wherein the second position corresponds to the toggle switch being in an off condition.

13. The method of claim 8, wherein disposing the switch cover device over the installed switch includes first passing the switch toggle through the switch yoke and then passing the switch toggle through a cover of said housing so the switch yoke is disposed between the installed switch and said cover of said housing of the switch cover device.

14. A switch cover device that fits over an installed switch having a switch toggle movable between a first position and a second position, the switch cover device comprising:

a housing that defines an aperture that receives the switch toggle;

a switch yoke pivotally coupled to said housing, wherein said switch yoke engages the switch toggle of the installed switch and pivots about said housing with the switch toggle between the first position and the second position;

a first linkage connected between said housing and said switch yoke and disposed on a first side of the switch toggle, said first linkage applies a force in a first direction when the switch toggle is in the second position and in response to an input signal received by the switch cover device, wherein said force from said first linkage in said first direction pivots said switch yoke and moves the switch toggle to the first position a second linkage connected between said housing and said switch yoke and disposed on a second, opposite side of the switch toggle, said second linkage applies a force in a second direction opposite said first direction when the switch toggle is in the first position in response to an input signal received by the switch cover device, wherein said force from said second linkage in said second direction pivots said switch yoke and moves the switch toggle to the second position, said first linkage and said second linkage are slack unless applying a force in response to said input signal to permit the installed switch to complete remaining motion of the switch toggle toward the first or the second positions.

15. The switch device of claim 14 further comprising: a timer that sends said input signal upon expiration of a period to move the switch toggle to the second position that corresponds to the installed switch being in an off condition.

16. The switch device of claim 14 further comprising: a motion detection sensor that sends said input signal upon detection of motion to move the switch toggle to the first position that corresponds to the installed switch being in an on condition.

17. The cover device of claim 14 further comprising: a timer and a motion detection sensor that send said input signal upon no detection of motion after an expiration of a period to move the switch toggle to the second position that corresponds to the toggle switch being in an off condition.

18. The cover device of claim 14, wherein said housing has a pair of apertures spaced apart a dimension defining a distance about equal to a distance between a pair of apertures on the installed switch, said pair of apertures are adapted to receive fasteners that secure an original cover to the installed switch.

19. The device of claim 18, wherein said housing has a cover having a front surface and a back surface, wherein said cover of said housing defines said pair of apertures through which fasteners pass to secure the switch cover device to the installed switch, said switch yoke is behind said cover adjacent said back surface, said switch yoke is disposed between said cover and the installed switch.

20. The device of claim 14 further comprising: a remote control that produces said input signal.

* * * * *

UNITED STATES PATENT AND TRADEMARK OFFICE

CERTIFICATE OF CORRECTION

PATENT NO. : 7,608,793 B2
APPLICATION NO. : 12/115797
DATED : October 27, 2009
INVENTOR(S) : Michael L. Agronin et al.

It is certified that error appears in the above-identified patent and that said Letters Patent is hereby corrected as shown below:

Title Page
Item [63] Related U.S. Application Data, line 2 "Jan. 25, 2005" should be -- Jan. 27, 2005 --.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,608,793 B2
APPLICATION NO. : 12/115797
DATED : October 27, 2009
INVENTOR(S) : Michael L. Agronin et al.

It is certified that error appears in the above-identified patent and that said Letters Patent is hereby corrected as shown below:

Title Page

Item [75] Inventors, lines 2 and 3, second inventor "James D. Marshall, Mallorytown, CA (US)" should be -- James D. Marshall, Mallorytown, ON (CA) --.

Signed and Sealed this

Tenth Day of August, 2010

David J. Kappos

David J. Kappos
*Director of the United States Patent and Trademark Office*